US010255852B2

(12) United States Patent
Kikuchi et al.

(10) Patent No.: US 10,255,852 B2
(45) **Date of Patent: *Apr. 9, 2019**

(54) COMPARATOR UNIT, DISPLAY, AND METHOD OF DRIVING DISPLAY

(71) Applicant: Sony Semiconductor Solutions Corporation, Kanagawa (JP)

(72) Inventors: Ken Kikuchi, Tokyo (JP); Takaaki Sugiyama, Kanagawa (JP); Takehiro Misonou, Kanagawa (JP); Genichiro Oga, Kanagawa (JP); Takahiro Kita, Kagoshima (JP)

(73) Assignee: Sony Semiconductor Solutions Corporation, Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/613,796

(22) Filed: Jun. 5, 2017

(65) Prior Publication Data

US 2017/0270858 A1 Sep. 21, 2017

Related U.S. Application Data

(63) Continuation of application No. 14/165,738, filed on Jan. 28, 2014, now Pat. No. 9,697,766.

(30) Foreign Application Priority Data

Feb. 4, 2013 (JP) ..... 2013-019290

(51) Int. Cl.
*G09G 3/3233* (2016.01)

(52) U.S. Cl.
CPC ..... *G09G 3/3233* (2013.01)

(58) Field of Classification Search
None
See application file for complete search history.

(56) References Cited

U.S. PATENT DOCUMENTS

2005/0225683 A1* 10/2005 Nozawa ..... G09G 3/2014 348/801
2007/0080905 A1 4/2007 Takahara
2012/0074856 A1 3/2012 Takata et al.

FOREIGN PATENT DOCUMENTS

JP 2002-359545 A 12/2002
JP 2003-223136 8/2003
JP 2003-223136 A 8/2003
JP 2013-153288 A 8/2013

OTHER PUBLICATIONS

Japanese Office Action dated Nov. 4, 2015 for corresponding Japanese Application No. 2013-019290.
Chinese Office Action dated Mar. 10, 2016 for corresponding Chinese Application No. 20140039844. 7.

* cited by examiner

*Primary Examiner* — Duane N Taylor, Jr.
(74) *Attorney, Agent, or Firm* — Michael Best & Friedrich LLP

(57) ABSTRACT

A comparator unit includes: a comparison section configured to compare a control pulse with an electric potential based on a signal voltage; and a control section configured to control, based on the control pulse, operation and non-operation of the comparison section.

7 Claims, 14 Drawing Sheets

COMPARATOR UNIT, DISPLAY, AND METHOD OF DRIVING DISPLAY

CROSS REFERENCE TO RELATED APPLICATIONS

This is a Continuation Application of U.S. application Ser. No. 14/165,738, filed Jan. 28, 2014, which claims the benefit of Japanese Priority Patent Application JP2013-19290 filed Feb. 4, 2013, the entire contents of which are incorporated herein by reference.

BACKGROUND

The present disclosure relates to a comparator unit, a display, and a method of driving the display.

Light emitting diode (LED) displays using LEDs as light-emission device has been actively developed. In an LED display, a light-emission section including a red LED serves as a red light-emitting sub-pixel, a light-emission section including a green LED serves as a green light-emitting sub-pixel, and a light-emission section including a blue LED serves as a blue light-emitting sub-pixel. The LED display displays a color image based on emission states of these three types of sub-pixels. For example, in a 40-inch-diagonal full-HD (High Definition) full color display, the number of pixels in a horizontal direction of a screen may be 1920, and the number of pixels in a vertical direction of the screen may be 1080. Therefore, in this case, the number of mounted LEDs is about six millions, which is 1920×1080× (the number of three types of LEDs, i.e. the red LEDs, the green LEDs, and the blue LEDs, which are necessary to configure one pixel).

In an organic electroluminescence display (hereinafter simply abbreviated to "organic EL display") using an organic electroluminescence device (hereinafter simply abbreviated to "organic EL device") as a light-emission section, a variable constant current driving method in which a light emission duty is fixed is widely used for a drive circuit that drives the light-emission section. Further, from the viewpoint of reducing light emission unevenness, a PWM-driven organic EL display is disclosed in, for example, Japanese Unexamined Patent Application Publication No. 2003-223136 (JP2003-223136A). In a method of driving an organic EL display disclosed in JP 2003-223136A, in a first period at the beginning of one frame period, an image signal voltage is written to each of all pixels, in a state in which light emission of a current-driven-type light-emission device in each of all the pixels is stopped. Further, in a second period following the first period in the one frame period, the current-driven-type light-emission devices of all the pixels are allowed to emit light simultaneously, within one or more light emission periods determined by the image signal voltage written to each of the pixels.

SUMMARY

In an LED, a blue shift occurs in a spectrum wavelength due to an increase in the amount of driving current, which causes variation in light-emission wavelength. Therefore, in variable constant current driving, there is such a disadvantage that a single-color chromaticity point is varied by luminance (the amount of driving current). In order to avoid such a disadvantage, it is necessary to drive the LED based on a PWM driving method. The drive circuit of the organic EL device disclosed in the above-mentioned JP 2003-223136A may be applied to a drive circuit of a light-emission section including an LED, but this case has the following disadvantage. That is, in the drive circuit of the organic EL device disclosed in the above-mentioned JP 2003-223136A, it is necessary to provide one comparator circuit in one pixel. Therefore, in a full-HD full color display, it is necessary to provide about six million comparator circuits. Accordingly, even if a dark current in the comparator circuit is of 1 microampere, a dark current of about 6 amperes flows in the entire display, leading to large power consumption.

It is desirable to provide a comparator unit having a configuration and a structure capable of reducing a flowing dark current or through current. It is also desirable to provide a display in which a drive circuit that drives a light-emission section is configured using such a comparator unit, and to provide a method of driving the display.

According to an embodiment of the present disclosure, there is provided a comparator unit including:

a comparison section configured to compare a control pulse with an electric potential based on a signal voltage; and a control section configured to control, based on the control pulse, operation and non-operation of the comparison section.

According to an embodiment of the present disclosure, there is provided a display including a plurality of pixels arranged in a two-dimensional matrix, the pixels each including a light-emission section and a drive circuit configured to drive the light-emission section, the drive section including (a) a comparator unit configured to compare a control pulse with an electric potential based on a signal voltage, and to output a predetermined voltage based on a comparison result, and (b) a light-emission-section driving transistor configured to supply a current to the light-emission section in response to the predetermined voltage from the comparator unit, thereby allowing the light-emission section to emit light, and the comparator unit including a comparison section configured to compare a control pulse with an electric potential based on a signal voltage, and a control section configured to control, based on the control pulse, operation and non-operation of the comparison section.

According to an embodiment of the present disclosure, there is provided a method of driving a display with a plurality of pixels arranged in a two-dimensional matrix, the pixels each including a light-emission section and a drive circuit configured to drive the light-emission section, the drive section including (a) a comparator unit configured to compare a control pulse with an electric potential based on a signal voltage, and to output a predetermined voltage based on a comparison result, and (b) a light-emission-section driving transistor configured to supply a current to the light-emission section in response to the predetermined voltage from the comparator unit, thereby allowing the light-emission section to emit light, the method including:

controlling, based on the control pulse, operation and non-operation of the comparator unit.

According to the above-described embodiments of the present disclosure, when it is not necessary to operate the comparator unit, the comparison section is allowed not to operate by the control pulse. Therefore, it is possible to reduce a dark current or a through current flowing through the comparator unit, despite its simple circuit configuration.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the present disclosure, and are incorporated in and constitute a part of this specification. The drawings illustrate embodiments and, together with the specification, serve to describe the principles of the technology.

DETAILED DESCRIPTION

Figure 1:
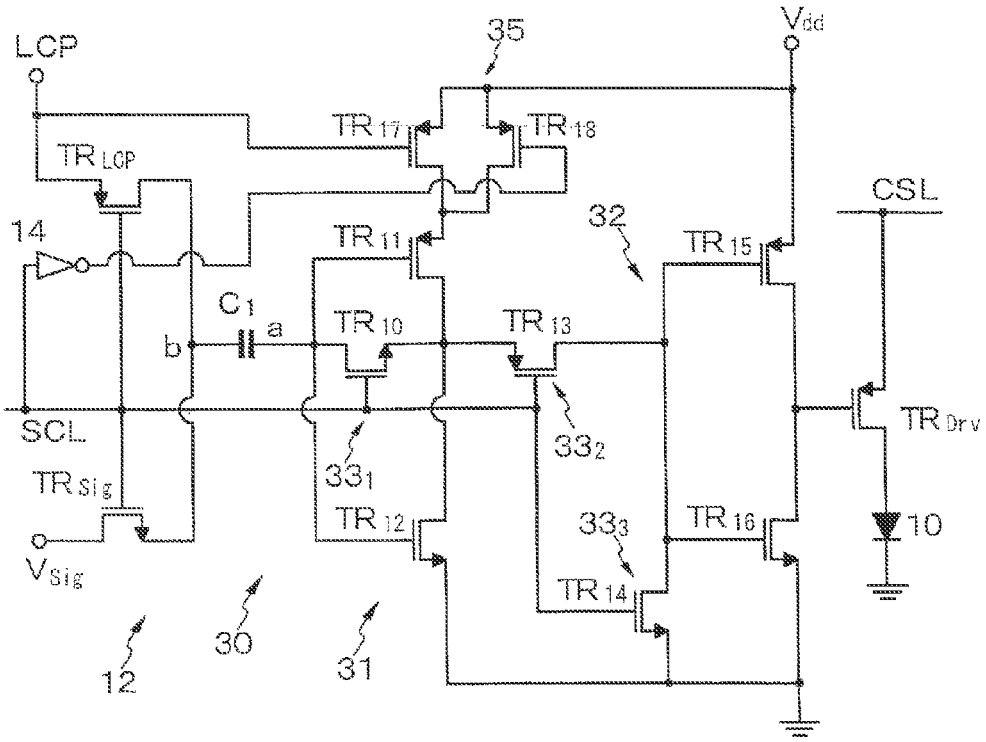
FIG. 1 is an equivalent circuit diagram of a pixel configured using a light-emission section and a drive circuit that includes a chopper-type comparator unit in a display of Example 1.

Some embodiments of the present disclosure will be described below based on Examples, with reference to the drawings. However, embodiments of the present disclosure are not limited to the Examples, and each of various kinds of numerical values and materials in the Examples is provided as an example. It is to be noted that the description will be provided in the following order.

1. Overall description of a comparator unit according to an embodiment of the present disclosure, as well as a display and a method of driving the display according to some embodiments of the present disclosure
2. Example 1 (a comparator unit [a comparator unit having a first configuration] according to an embodiment of the present disclosure, as well as a display and a method of driving the display according to some embodiments of the present disclosure)
3. Example 2 (a modification of Example 1 [a comparator unit having a second configuration])
4. Example 3 (a modification of any of Examples 1 and 2)
5. Example 4 (a modification of any of Examples 1 to 3)
6. Example 5 (a modification of any of Examples 1 to 4)
7. Example 6 (a modification of any of Examples 1 to 5), and others

[Overall Description of a Comparator Unit According to an Embodiment of the Present Disclosure, as Well as a Display and a Method of Driving the Display According to Some Embodiments of the Present Disclosure]

In a comparator unit according to an embodiment of the present disclosure, as well as a display and a method of driving the display according to some embodiments of the present disclosure (these may be hereinafter collectively referred to simply as "embodiments of the present disclosure"), a comparison section includes a signal writing transistor configured to receive the signal voltage, a control-pulse transistor configured to receive the control pulse, and configured to perform ON-OFF operation based on a signal of a phase opposite to a phase of a signal used by the signal writing transistor, an inverter circuit, and a capacity section having a first end and a second end, and configured to retain, based on operation of the signal writing transistor, the electric potential based on the signal voltage, the first end being connected to the signal writing transistor and the control-pulse transistor, and the second end being connected to the inverter circuit.

It is to be noted that a comparator unit having such a configuration will be referred to as "a comparator unit having a first configuration", for convenience.

In the comparator unit having the first configuration, the control section may include a first switching circuit connected in series to the inverter circuit, and configured to perform ON-OFF operation based on the sawtooth-waveform voltage variation of the control pulse. Further, in this case, the control section may include a second switching circuit connected in parallel to the first switching circuit, and configured to be in an ON state during an operation period of the comparator unit. Further, in any of the comparator units having the first configuration including the above-described forms, the control section may include a resistive element connected in series to the inverter circuit. Further, in any of the comparator units having the first configuration including the above-described forms, the control section may include a constant current source connected in series to the inverter circuit, and configured to suppress a current flowing through the inverter circuit. Further, the inverter circuit may include inverters in two-or-more-stage cascade connection, and the constant current source may be connected to the inverter of a first stage on a side, with respect to the inverter of the first stage, where one of a power supply on high potential side and a power supply on low potential side is provided, and the constant current source may be connected to the inverter of a second stage on a side, with respect to the inverter of the second stage, where the other of the power supply on the high potential side and the power supply on the low potential side is provided.

Alternatively, according to an embodiment of the present disclosure, the comparison section may include a differential circuit configured to receive the signal voltage and the control pulse as two inputs, and a constant current source configured to supply a constant current to the differential circuit.

It is to be noted that a comparator unit having such a configuration will be referred to as "a comparator unit having a second configuration", for convenience.

In the comparator unit having the second configuration, the comparison section may further include a signal writing transistor configured to receive the signal voltage, and a capacity section connected to the signal writing transistor, and configured to retain, based on operation of the signal writing transistor, the electric potential based on the signal voltage.

Further, in the comparator unit having the second configuration including the above-described forms, the control section may include a third switching circuit connected in series to the constant current source, and configured to perform ON-OFF operation based on the sawtooth-waveform voltage variation of the control pulse. In this case, the control section may include a second switching circuit connected in series to a constant-voltage circuit, and configured to perform ON-OFF operation based on the sawtooth-waveform voltage variation of the control pulse, the constant-voltage circuit being configured to apply a constant voltage to a gate electrode of a transistor configuring the constant current source.

In the display and the method of driving the display according to some embodiments of the present disclosure including the above-described various preferable configurations and forms, a plurality of pixels are arranged in a two-dimensional matrix in a first direction and a second direction. A pixel group arranged in the first direction may be referred to as "column-direction pixel group" in some cases, and a pixel group arranged in the second direction may be referred to as "row-direction pixel group" in some cases. When the first direction is assumed to be a vertical direction in the display and the second direction is assumed to be a horizontal direction in the display, the column-direction pixel group refers to a pixel group arranged in the vertical direction, and the row-direction pixel group refers to a pixel group arranged in the horizontal direction.

In the display and the method of driving the display according to some embodiments of the present disclosure including the above-described various preferable configurations and forms, the plurality of pixels may be arranged in a two-dimensional matrix in a first direction and a second direction, and are divided into a P-number of pixel blocks in the first direction, and the light-emission sections configuring pixels belonging to first to P-th pixel blocks may be allowed to emit light simultaneously on a pixel-block basis sequentially in order from the first to P-th pixel blocks, and when the light emission sections configuring the pixels belonging to part of the pixel blocks are allowed to emit light, the light emission sections configuring the pixels belonging to rest of the pixel blocks may not be allowed to emit light.

In the display and the method of driving the display according to some embodiments of the present disclosure including the above-described various preferable configurations and forms, the light-emission section may emit light a plurality of times based on a plurality of the control pulses. Further, in this case, a time interval of the plurality of control pulses may be preferably constant.

Further, in the display and the method of driving the display according to some embodiments of the present disclosure including the above-described various preferable configurations and forms, number of the control pulses supplied to the drive circuits in one display frame may be less than number of the control pulses in one display frame. This form may be achieved by, when a series of a plurality of control pulses are generated in one display frame, and the light-emission sections of the pixels belonging to one pixel block are not allowed to emit light, masking part of the series of the plurality of control pulses, not to supply the control pulses to the drive circuits of the pixels belonging to the one pixel block.

Furthermore, in the display and the method of driving the display according to some embodiments of the present disclosure including the above-described various preferable configurations and forms, light may be emitted mostly from any of the pixel blocks in one display frame, or the pixel block from which no light is emitted may be present in one display frame.

Still furthermore, in the display and the method of driving the display according to some embodiments of the present disclosure including the above-described various preferable configurations and forms, an absolute value of a voltage of each of the control pulses may preferably increase and then decrease over time. This allows the light-emission sections of all the pixels belonging to each pixel block to emit light at the same timing. In other words, temporal centers of gravity of light emission of the light-emission sections in all the pixels belonging to each pixel block are allowed to be synchronized (agree) with one another. In this case, preferably, gamma correction may be performed based on the voltage of the control pulse varying over time, and this allows the entire circuit of the display to be simplified. It is to be noted that, preferably, an absolute value of a variation rate (a derivative value) of the voltage of the control pulse in which time is a variable may be proportional to a constant 2.2.

Besides, in the display and the method of driving the display according to some embodiments of the present disclosure including the above-described various preferable configurations and forms, the light-emission section may include a light emitting diode (LED). The LED may be an LED having well-known configuration and structure. In other words, depending on the light emission color of an LED, an LED having optimal configuration and structure and fabricated using an appropriate material may be selected. In the display using the LED as the light-emission section, the light-emission section including a red LED serves as a red light-emitting sub-pixel, the light-emission section including a green LED serves as a green light-emitting sub-pixel, and the light-emission section including a blue LED serves as a blue light-emitting sub-pixel. One pixel may be configured using these three types of sub-pixels, and a color image may be displayed based on emission states of these three types of sub-pixels. It is to be noted that "one pixel" in an embodiment of the present disclosure corresponds to "one sub-pixel" in such a display. Therefore, "one sub-pixel" in such a display may be read as "one pixel". When one pixel is configured using three types of sub-pixels, any of a delta arrangement, a stripe arrangement, a diagonal arrangement, and a rectangle arrangement may be used as an arrangement of the three types of sub-pixels. In addition, it is possible to prevent occurrence of a blue shift in a spectrum wavelength of the LED, by driving the LED based on a PWM driving method, and also through constant current driving. Further, application to a projector is also possible. In this projector, three panels are prepared, a first panel is configured using the light-emission section including the red LED, a second panel is configured using the light-emission section including the green LED, a third panel is configured using the light emission section including the blue LED, and light rays from these three panels may be gathered using, for example, a dichroic prism.

It is to be noted that, in the display according to an embodiment of the present disclosure including the above-described various preferable configurations and forms, t the pixel belonging to one line arranged in the second direction may be connected to a control pulse line, and voltage follower circuits (buffer circuits) may be disposed at a predetermined interval (for every predetermined number of pixels) in the control pulse line. This makes it less likely to cause waveform dullness in the control pulse transmitted through the control pulse line. Here, for example, a configuration in which one voltage follower circuit is provided for ten to twenty pixels belonging to one line in the second direction (pixels in the row-direction pixel group) may be described as an example, but this is not limitative.

Furthermore, in the display according to an embodiment of the present disclosure including the above-described various preferable configurations and forms, in each pixel block, the signal writing transistors in all the pixels (the row-direction pixel group) belonging to one line arranged in the second direction may be allowed to be in an operation state simultaneously. In such a configuration, the operation, in which the signal writing transistors in the row-direction pixel group are allowed to be in the operation state simultaneously, may be sequentially performed from the signal writing transistors in the row-direction pixel group of a first row to the signal writing transistors in the row-direction pixel group of a last row, in each pixel block. In other words, in each pixel block, such an operation may be performed from the signal writing transistors in all of the pixels belonging to the first row to the signal writing transistors in all of the pixels belonging to the last row that are arranged in the first direction. Further, in each pixel block, this operation, in which the signal writing transistors in the row-direction pixel group are caused to be in the operation state simultaneously, may be sequentially performed, from the signal writing transistors in the row-direction pixel group of the first row, to the signal writing transistors in the row-direction pixel group of the last row, and subsequently, the control pulses may be supplied to this pixel block. It is to be noted that, a time period during which, in each pixel block, the operation, in which the signal writing transistors in the row-direction pixel group are allowed to be in the operation state simultaneously, is sequentially performed, from the signal writing transistors in the row-direction pixel group of the first row, to the signal writing transistors in the row-direction pixel group of the last row, may be referred to as "signal-voltage writing period" in some cases. Further, a time period during which the light-emission sections of all of the pixels belonging to each pixel block are allowed to emit light simultaneously, may be referred to as "pixel-block light emission period" in some cases.

Still furthermore, in the display according to an embodiment of the present disclosure including the above-described various preferable configurations and forms, one control-pulse generation circuit that generates a control pulse having sawtooth-waveform voltage variation may be provided. By adopting such a form, the light emission of the light emission sections is controlled precisely, without causing variations in a series of control pulses. Alternatively, in the display according to an embodiment of the present disclosure including the above-described various preferable configurations and forms, a plurality of control-pulse generation circuits that each generate the control pulse having the sawtooth-waveform voltage variation may be provided. By adopting such a form, a larger value is allowed to be adopted as a value of P. It is to be noted that the shapes of the control pulses generated by the plurality of control-pulse generation circuits may be preferably as similar as possible, and preferably, the phases of the control pulses generated by the plurality of control-pulse generation circuits may be shifted from one another (have a phase difference).

Example 1

Figure 2:
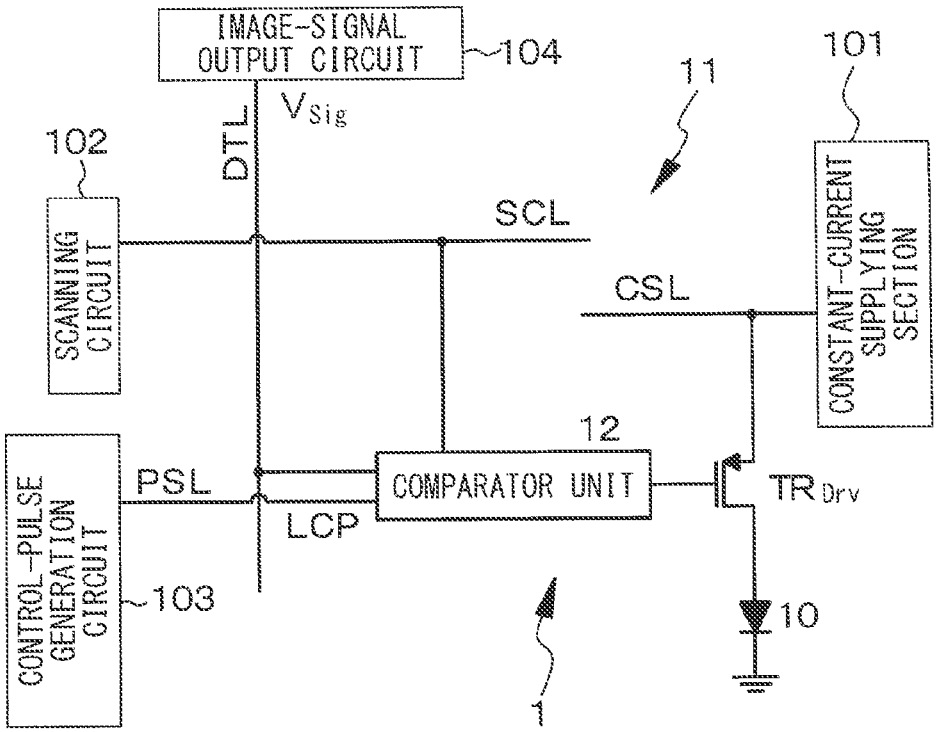
FIG. 2 is a conceptual diagram of the pixel and the like, the pixel being configured using the light-emission section and the drive circuit in the display of Example 1.
Figure 3:
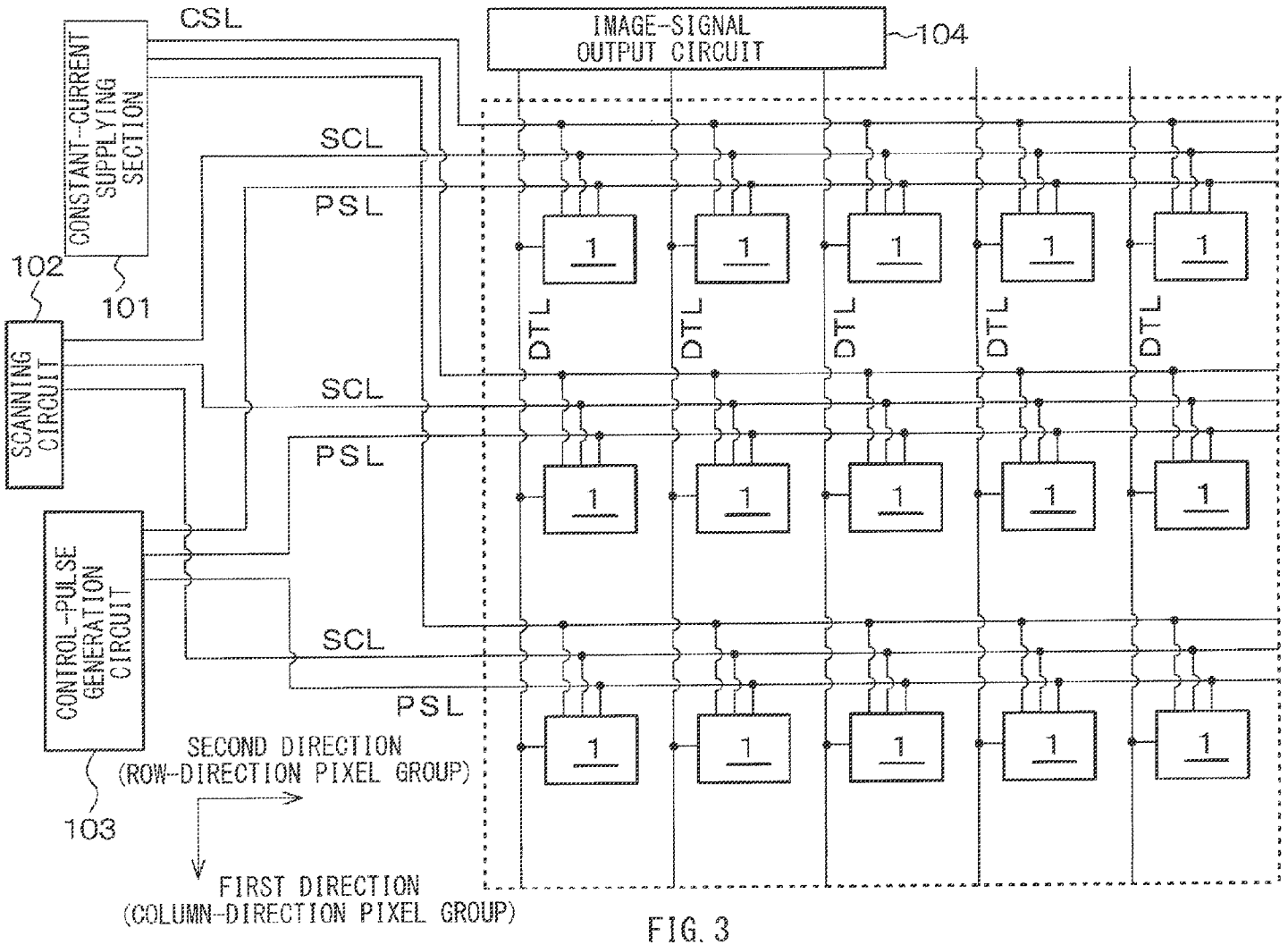
FIG. 3 is a conceptual diagram of circuits included in the display of Example 1.
Figure 13:
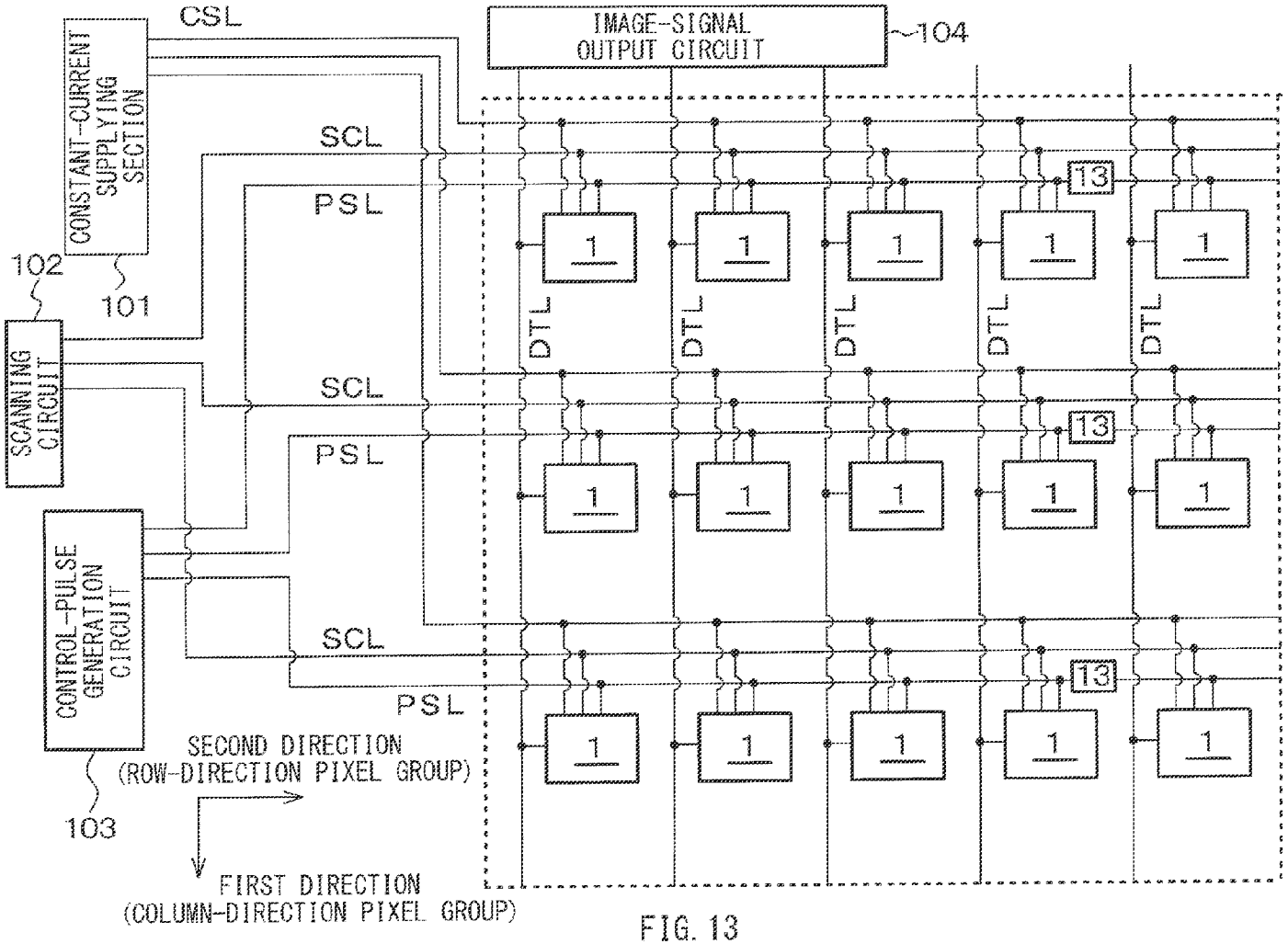
FIG. 13 is a conceptual diagram of a circuit used to configure a display of Example 6.

Example 1 relates to a comparator unit according to an embodiment of the present disclosure, specifically, a comparator unit having the first configuration. Example 1 also relates to a display and a method of driving the display according to an embodiment of the present disclosure. FIG. 1 illustrates an equivalent circuit diagram of the comparator unit of Example 1. FIG. 2 illustrates a conceptual diagram of a pixel and the like in the display of Example 1. The pixel includes a light-emission section and a drive circuit. FIG. 3 illustrates a conceptual diagram of circuits included in the display of Example 1. For simplification of drawings, 3×5 pixels are illustrated in FIG. 3 and FIG. 13 to be described later.

A comparator unit 12 of Example 1 includes a comparison section and a control section 35. The comparison section compares a control pulse LCP, with an electric potential based on a signal voltage $V_{Sig}$. The control section 35 controls operation and non-operation of the comparison section, based on the control pulse LCP.

The display of Example 1 include a plurality of pixels (to be more specific, sub-pixels, and the same is applicable in the following description) 1 that are arranged in a two-dimensional matrix. Each of the pixels 1 includes a light-emission section 10 and a drive circuit 11 that drives the light-emission section 10. Specifically, the plurality of pixels 1 are arranged in a two-dimensional matrix, in a first direction and a second direction. The plurality of pixels 1 are divided into P-number of pixel blocks in the first direction. Each of the drive circuits 11 includes (a) a comparator unit configured to compare the control pulse LCP with an electric potential based on the signal voltage (emission intensity signal) $V_{Sig}$, and to output a predetermined voltage (that will be referred to as "first predetermined voltage" for convenience) based on a comparison result, and (b) a light-emission-section driving transistor $TR_{Drv}$ configured to supply a current to the light-emission section 10 in response to the first predetermined voltage from the comparator unit, thereby allowing the light-emission section 10 to emit light.

It is to be noted that the signal voltage $V_{Sig}$ is, specifically, an image signal voltage that controls a light emission state (luminance) in the pixel. In this example, specifically, the comparator unit is connected to a control pulse line PSL and a data line DTL. The comparator unit compares the control pulse LCP having sawtooth-waveform voltage variation and sent from the control pulse line PSL, with the electric potential based on the signal voltage (the emission intensity signal) $V_{Sig}$ from the data line DTL, and outputs the predetermined voltage based on the comparison result. Further, the light-emission-section driving transistor $TR_{Drv}$ is allowed to operate by the output of the first predetermined voltage from the comparator unit. This allows the light-emission-section driving transistor $TR_{Drv}$ to supply a current from a current supply line CSL to the light-emission section 10, thereby allowing the light emission section 10 to emit light. This comparator unit is configured of the comparator unit 12 of Example 1.

The comparator unit 12 of Example 1 is configured of a chopper-type comparator unit. Further, the display of Example 1 includes a control-pulse generation circuit 103 that generates the control pulse LCP having the sawtooth-waveform voltage variation.

Alternatively, the display of Example 1 may be a display in which the plurality of pixels 1 are arranged in a two-dimensional matrix, each of the pixels 1 includes the light-emission section 10 and the drive circuit 11, and the drive circuit 11 allows the light-emission section 10 to emit light only for a time period in accordance with the electric potential based on the signal voltage $V_{Sig}$. In this example, for example, the drive circuit 11 may include the above-described comparator unit 12 of Example 1. The control pulse LCP and the signal voltage $V_{Sig}$ are inputted to the comparator unit 12, and the light-emission section 10 is allowed to operate by output of the comparator unit 12 based on a result of a comparison between the sawtooth-waveform voltage of the control pulse LCP and the electric potential based on the signal voltage $V_{Sig}$.

In this example, as described above, the comparator unit 12 of Example 1 is configured of the comparator unit having the first configuration. Specifically, the comparison section includes a signal writing transistor $TR_{Sig}$ configured to receive the signal voltage $V_{Sig}$, a control-pulse transistor $TR_{LCP}$ configured to receive the control pulse LCP, and configured to perform ON-OFF operation based on a signal of a phase opposite to a phase of a signal used by the signal writing transistor $TR_{Sig}$, an inverter circuit 30, and a capacity section $C_1$ having a first end and a second end, and configured to retain, based on operation of the signal writing transistor $TR_{Sig}$, the electric potential based on the signal voltage $V_{Sig}$, the first end being connected to the signal writing transistor $TR_{Sig}$ and the control-pulse transistor $TR_{LCP}$, and the second end being connected to the inverter circuit 30.

Further, a power supply $V_{dd}$ on high potential side and a power supply on low voltage side (a ground GND in Example 1) are each provided as an operation power supply.

The signal writing transistor $TR_{Sig}$, the control-pulse transistor $TR_{LCP}$, and the light-emission-section driving transistor $TR_{Drv}$ are each configured of a typical field-effect transistor that includes a gate electrode, a channel forming region, and source and drain electrodes. The signal writing transistor $TR_{Sig}$ is an n-channel-type field-effect transistor, and each of the control-pulse transistor $TR_{LCP}$ and the light-emission-section driving transistor $TR_{Drv}$ is a p-channel-type field-effect transistor, although the signal writing transistor $TR_{Sig}$, the control-pulse transistor $TR_{LCP}$, and the light-emission-section driving transistor $TR_{DRV}$ are not limited to such channel types.

The gate electrode of the signal writing transistor $TR_{Sig}$ is connected to a scanning circuit 102 included in the display, through a scanning line SCL. Further, one of the source and drain electrodes of the signal writing transistor $TR_{Sig}$ is connected to an image-signal output circuit 104 included in the display, through the data line DTL. Furthermore, the other of the source and drain electrodes of the signal writing transistor $TR_{Sig}$ is connected to the first end of the capacity section $C_1$.

The gate electrode of the control-pulse transistor $TR_{LCP}$ is connected to the scanning circuit 102 included in the display, through the scanning line SCL. Further, one of the source and drain electrodes of the control-pulse transistor $TR_{LCP}$ is connected to the control-pulse generation circuit 103 included in the display, through the control pulse line PSL. Furthermore, the other of the source and drain electrodes of the control-pulse transistor $TR_{LCP}$ is connected to the first end of the capacity section $C_1$.

The gate electrode of the light-emission-section driving transistor $TR_{Drv}$ is connected to an output terminal of the inverter circuit 30. Further, one of the source and drain electrodes of the light-emission-section driving transistor $TR_{Drv}$ is connected to a constant-current supplying section 101 included in the display, through the current supply line CSL. Furthermore, the other of the source and drain electrodes of the light-emission-section driving transistor $TR_{Drv}$ is connected to the light-emission section 10.

To the signal writing transistor $TR_{Sig}$, the signal voltage (the emission intensity signal) $V_{Sig}$ is inputted. To the control-pulse transistor $TR_{LCP}$, on the other hand, the control pulse LCP having the sawtooth-waveform voltage variation is inputted.

The second end of the capacity section $C_1$ is connected to an input terminal (an input node) of the inverter circuit 30. Further, the light-emission section 10 includes an LED. It is to be noted that the constant-current supplying section 101, the scanning circuit 102, the control-pulse generation circuit 103, the image-signal output circuit 104, and the like may be disposed in the display, or may be disposed outside the display.

The signal writing transistor $TR_{Sig}$ and the control-pulse transistor $TR_{LCP}$ each perform ON-OFF operation, according to logic (level) of a scanning signal supplied from the scanning circuit 102 through the scanning line SCL. The signal writing transistor $TR_{Sig}$ and the control-pulse transistor $TR_{LCP}$ are configured of the transistors having opposite conductivity type to each other, and therefore perform the ON-OFF operation with signals of phases opposite to each other (reverse logic).

Of the capacity section $C_1$, the first end is connected to the other end of each of the signal writing transistor $TR_{Sig}$ and the control-pulse transistor $TR_{LCP}$, namely, the source electrode of the signal writing transistor $TR_{Sig}$ of an n-channel type, and the drain electrode of the control-pulse transistor $TR_{LCP}$ of a p-channel type. Then, based on the operation of the signal writing transistor $TR_{Sig}$, the capacity section $C_1$ retains an electric potential based on the signal voltage $V_{Sig}$.

The inverter circuit 30 may have, for example, a configuration in which inverters are in two-stage cascade connection. Further, the output terminal (an output node) of the inverter circuit 30 is connected to the gate electrode of the light-emission-section driving transistor $TR_{Drv}$. A first stage of the inverter circuit 30 is configured using a CMOS inverter 31. The CMOS inverter 31 of the first stage includes a p-channel-type field-effect transistor $TR_{11}$ and an n-channel-type field-effect transistor $TR_{12}$ which have gate electrodes connected to each other, and are connected in series between the power supply $V_{dd}$ on the high potential side and the power supply GND on the low potential side. Between an input terminal (an input node) and an output terminal (an output node) of the CMOS inverter 31 of the first stage, for example, an n-channel-type field-effect transistor $TR_{10}$ may be disposed as a first switch section $\mathbf{33}_1$ that selectively short-circuits or opens between these input and output terminals. The first switch section $\mathbf{33}_1$ performs ON-OFF (short-circuit or open) operation according to logic (level) of a scanning signal provided through the scanning line SCL.

A second stage of the inverter circuit 30 is configured using a CMOS inverter 32. The CMOS inverter 32 of the second stage includes a p-channel-type field-effect transistor $TR_{15}$ and an n-channel-type field-effect transistor $TR_{16}$ which have gate electrodes connected to each other, and are connected in series between the power supply $V_{dd}$ on the high potential side and the power supply GND on the low potential side.

Between the output terminal of the CMOS inverter 31 of the first stage and an input terminal of the CMOS inverter 32 of the second stage, for example, a p-channel-type transistor $TR_{13}$ may be disposed as a second switch section $\mathbf{33}_2$ that selectively short-circuits or opens between these input and output terminals. The second switch section $\mathbf{33}_2$ performs ON-OFF (short-circuit or open) operation, according to logic (level) of the scanning signal provided through the scanning line SCL. In this example, the first switch section $\mathbf{33}_1$ and the second switch section $\mathbf{33}_2$ are configured of transistors having opposite conductivity types to each other, and perform the ON-OFF operation with signals of phases opposite to each other (reverse logic).

Between the input terminal of the CMOS inverter 32 of the second stage and the power supply GND on the low potential side, for example, an n-channel-type field-effect transistor $TR_{14}$ may be disposed as a third switch section $\mathbf{33}_3$ that selectively grounds the input terminal of the CMOS inverter 32 of the second stage. The third switch section $\mathbf{33}_3$ performs ON-OFF (ground-open) operation, according to logic (level) of the scanning signal provided through the scanning line SCL. In this example, the second switch section $\mathbf{33}_2$ and the third switch section $\mathbf{33}_3$ are configured of transistors having opposite conductivity types to each other, and therefore perform the ON-OFF operation with signals of phases opposite to each other (reverse logic).

An output terminal of the CMOS inverter 32 of the second stage, namely, the output terminal of the inverter circuit 30, serves as an output terminal of the chopper-type comparator unit 12 of Example 1. To this output terminal, the gate electrode of the light-emission-section driving transistor $TR_{Drv}$ is connected. When a first predetermined voltage (L) is outputted from the inverter circuit 30, the light-emission-section driving transistor $TR_{Drv}$ becomes ON state, and supplies a current to the light-emission section 10. The light-emission section 10 is allowed to emit light, by being thus driven by the light-emission-section driving transistor $TR_{Drv}$.

The chopper-type comparator unit 12 of the configuration described above is a reference example. Operation of the chopper-type comparator unit 12 in this reference example will be described with reference to a timing waveform diagram in FIG. 5.

Figure 4:
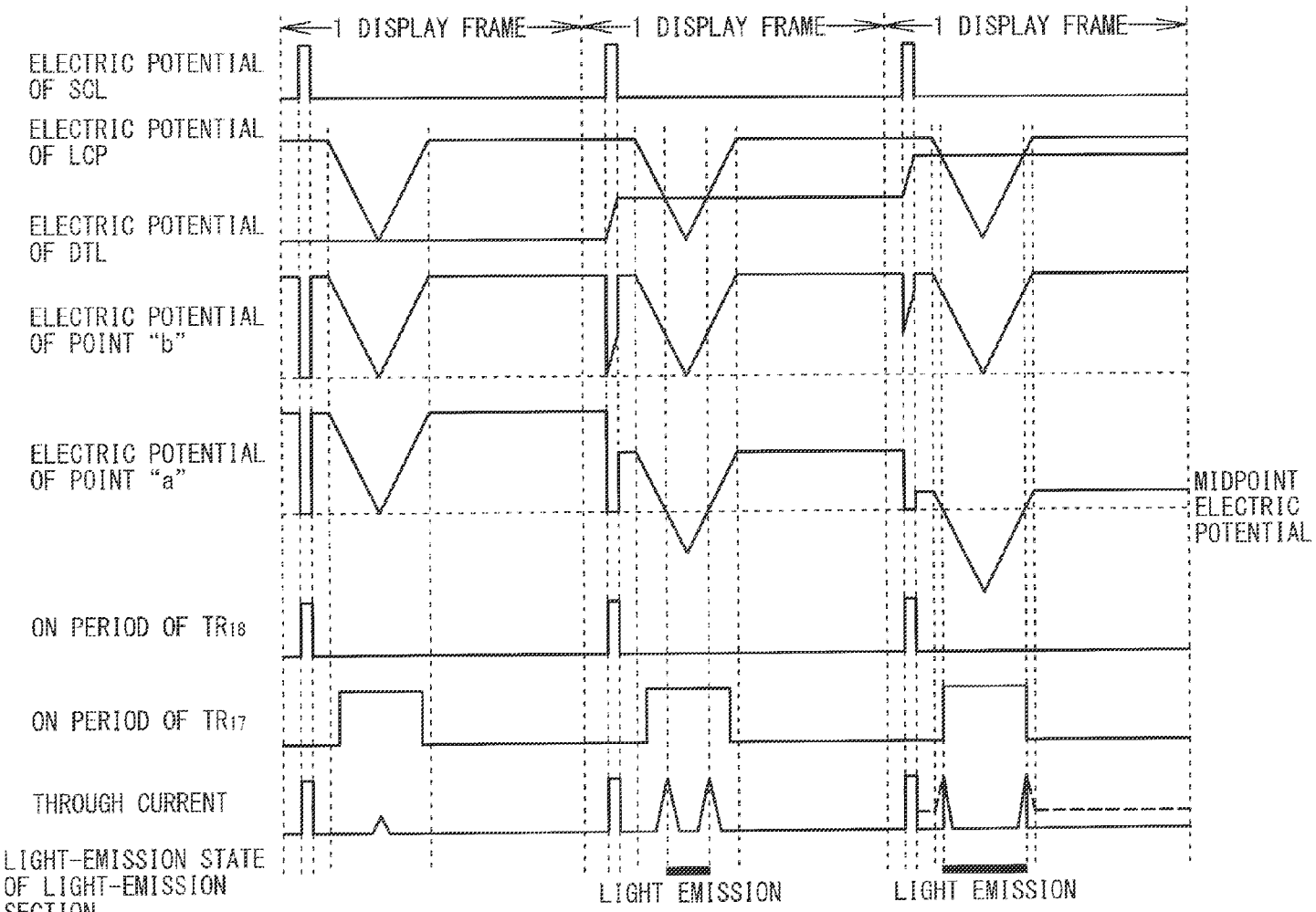
FIG. 4 is a timing waveform diagram used to describe operation of the chopper-type comparator unit in the display of Example 1.
Figure 5:
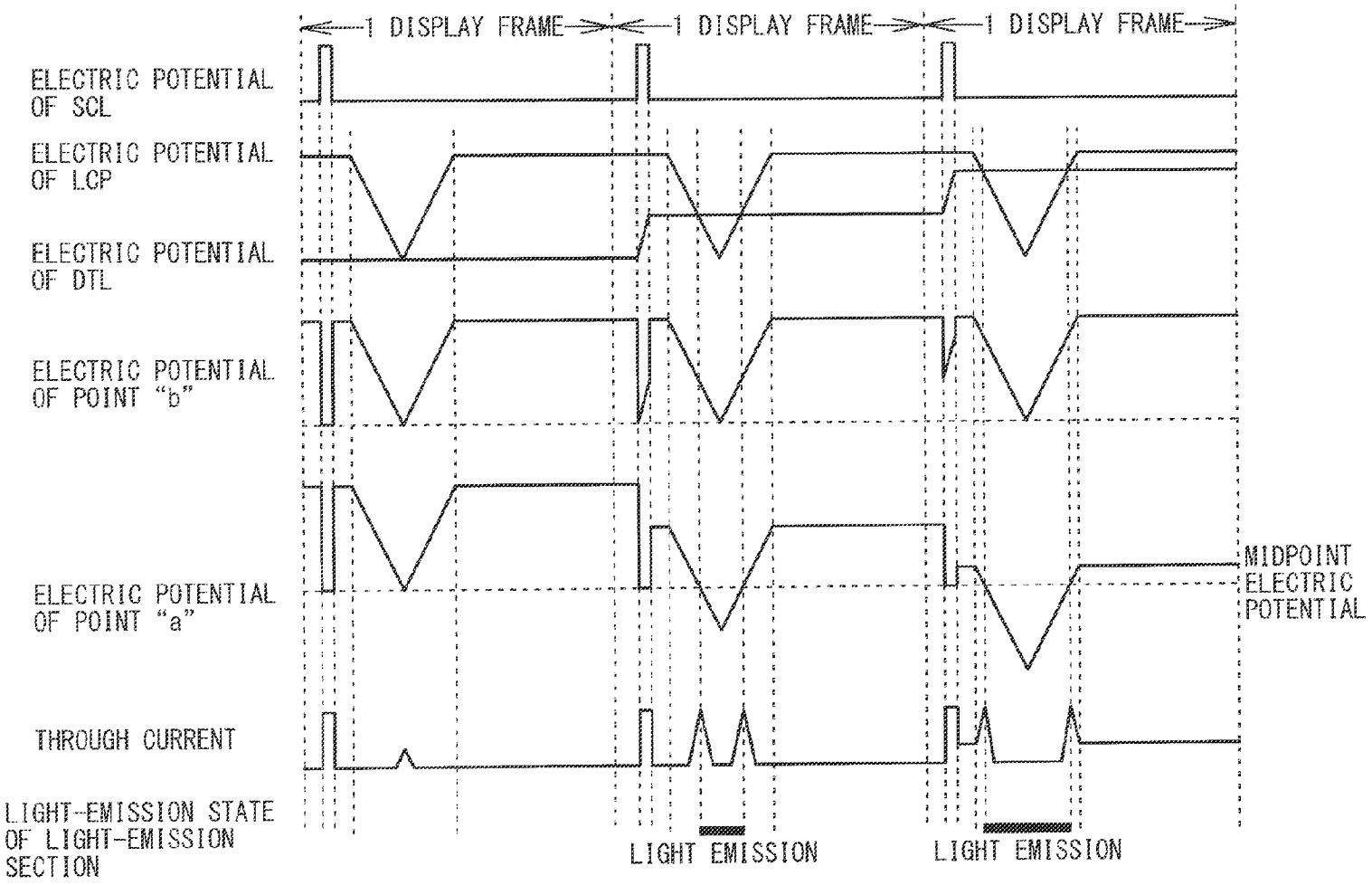
FIG. 5 is a timing waveform diagram used to describe a disadvantage in a chopper-type comparator unit in a display of a reference example.

FIG. 5 and FIG. 4 to be described later each illustrate an electric potential of the scanning line SCL (an electric potential of the scanning signal), an electric potential of the control pulse LCP, an electric potential of the data line DTL (an electric potential of the signal voltage $V_{Sig}$), an electric potential of a point "b" (the first end of the capacity section $C_1$), an electric potential of a point "a" (the second end of the capacity section $C_1$), a through current, and a light-emission state of the light-emission section 10, and the like. It is to be noted that operation of one pixel in one pixel block will be described, for easy understanding. Also, FIG. 5 and FIG. 4 to be described later each illustrate only one control pulse LCP, in one display frame.

First, during a period in which the electric potential of the scanning line SCL is at high level, the signal writing transistor $TR_{Sig}$, the first switch section $\mathbf{33}_1$, and the third switch section $\mathbf{33}_3$ are in ON state, and the control-pulse transistor $TR_{LCP}$ and the second switch section $\mathbf{33}_2$ are in OFF state. Accordingly, the electric potential of the data line DTL (the electric potential of the signal voltage $V_{Sig}$) is taken in by the signal writing transistor $TR_{Sig}$ and applied to the capacity section $C_1$. Therefore, the electric potential of the point "b" becomes the electric potential of the data line DTL. Further, the first switch section $\mathbf{33}_1$ develops a short circuit between the input terminal and the output terminal of the CMOS inverter 31 of the first stage. Therefore, the electric potential of the point "a" becomes a threshold (inversion level) of the CMOS inverter 31 of the first stage, namely, a midpoint electric potential between the power supply $V_{dd}$ on the high potential side and the power supply GND on the low potential side. As a result, electric charge in accordance with the electric potential of the data line DTL, namely, the electric potential based on the signal voltage $V_{Sig}$, is accumulated in the capacity section $C_1$.

Next, during a period in which the electric potential of the scanning line SCL is at low level, the signal writing transistor $TR_{Sig}$, the first switch section $\mathbf{33}_1$, and the third switch section $\mathbf{33}_3$ are in OFF state, and the control-pulse transistor $TR_{LCP}$ and the second switch section $\mathbf{33}_2$ are in ON state. Accordingly, the electric potential of the control pulse LCP is taken in by the control-pulse transistor $TR_{LCP}$ and applied to the capacity section $C_1$. Therefore, the electric potential of the point "b" becomes the electric potential of the control pulse LCP. At this time, with respect to the capacity section $C_1$ where the electric charge in accordance with the electric potential based on the signal voltage $V_{Sig}$ has been accumulated, the electric potential of the control pulse LCP is applied, and as a result, the electric potential of the point "a", namely, the input voltage of the CMOS inverter 31 of the first stage, becomes a difference voltage between the electric potential based on the signal voltage $V_{Sig}$ and the electric potential of the control pulse LCP.

The difference voltage between the electric potential based on the signal voltage $V_{Sig}$ and the electric potential of the control pulse LCP is inverted at the CMOS inverter 31 of the first stage, and further inverted at the CMOS inverter 32 of the second stage because the second switch section $\mathbf{33}_2$ is in ON state. This difference voltage is then outputted as the first predetermined voltage (L), and supplied to the gate electrode of the light-emission-section driving transistor $TR_{Drv}$. Subsequently, the light-emission section 10 is driven under the control of the light-emission-section driving transistor $TR_{Drv}$ based on the first predetermined voltage. As a result, during a period in which the electric potential of the point "a" is lower than the midpoint electric potential that is the threshold of the CMOS inverter 31 of the first stage, the light-emission section 10 is in the light-emission state.

Meanwhile, in the reference example with the chopper-type comparator unit whose operation has been described above, the electric potential of the point "a" at the time of white display is mostly in the neighborhood of the inversion level (midpoint electric potential) of the CMOS inverter 31 of the first stage, as indicated in the third display frame, in the timing waveform diagram of FIG. 5. Therefore, when it is not necessary to operate the comparator unit, in other words, in a high-level period (a period in which the sawtooth-waveform voltage exceeds a threshold voltage) of the control pulse LCP, a through current flows through the field-effect transistors $TR_{11}$ and $TR_{12}$ in the CMOS inverter 31 of the first stage. It is to be noted that, in the timing waveform diagram of FIG. 5, a first display frame represents an electric potential relationship at the time of black display.

This through current is a disadvantage that is applicable not only to the chopper-type comparator unit but also to a differential-type comparator unit of Example 2 to be described later. In other words, in the case of the differential-type comparator unit of Example 2 to be described later, a constant current source 42 is used, and therefore, a through current flows most of the time. In Example 1, the operation and non-operation of the comparator unit are controlled based on the control pulse LCP. This allows a reduction in dark current or through current flowing through the drive circuit 11.

In other words, in Example 1, the comparator unit 12 includes the control section 35 that controls the operation and non-operation of the comparator unit 12, based on the control pulse LCP. Specifically, the control section 35 controls the operation and non-operation of the comparator unit 12, by controlling operation and non-operation of the comparison section, in particular, the operation and non-operation of the inverter circuit 30. Also, the operation and non-operation of the comparator unit 12 is controlled based on the control pulse LCP, in the method of driving the display of Example 1 as well.

The control section 35 may include, for example, a p-channel-type field-effect transistor $TR_{17}$, as a switching circuit (which will be referred to as "first switching circuit" for convenience) that is connected in series to the inverter circuit 30, more specifically, to the CMOS inverter 31 of the first stage. This switching circuit performs ON-OFF operation based on the sawtooth-waveform voltage of the control pulse LCP. When it is not necessary to operate the comparator unit 12, in other words, in the high-level period (the period in which the sawtooth-waveform voltage exceeds the threshold voltage) of the control pulse LCP, the p-channel-type field-effect transistor $TR_{17}$ is in OFF state, and allows the comparator unit 12 to be in a non-operation state, by separating the CMOS inverter 31 of the first stage from the power supply $V_{dd}$ on the high potential side.

In this example, it is enough that amplitude of the sawtooth waveform of the control pulse LCP is within a variable range of the signal voltage (the emission intensity signal) $V_{Sig}$, and the absolute value of the electric potential thereof is arbitrary. Therefore, in the example illustrated in FIG. 1, the electric potential in the high-level period of the control pulse LCP is set to be about the electric potential of the power supply $V_{dd}$, and the p-channel-type field-effect transistor $TR_{17}$ is set to be in the OFF state to separate the CMOS inverter 31 of the first stage from the power supply $V_{dd}$, in the high-level period of the control pulse LCP.

However, even in the high-level period of the control pulse LCP, it is necessary to operate the comparator unit 12 when the scanning signal provided through the scanning line SCL is at high level. Therefore, the control section 35 may have, for example, a p-channel-type field-effect transistor $TR_{18}$ as a second switching circuit, in addition to the p-channel-type field-effect transistor $TR_{17}$. The p-channel-type field-effect transistor $TR_{18}$ is connected in parallel to the p-channel-type field-effect transistor $TR_{17}$ used to configure the first switching circuit. A scanning signal is applied to a gate electrode of the p-channel-type field-effect transistor $TR_{18}$, through an inverter 14. This causes, when the scanning signal is at high level, the p-channel-type field-effect transistor $TR_{18}$ used to configure the second switching circuit becomes ON state, thereby connecting the CMOS inverter 31 of the first stage to the power supply $V_{dd}$.

Focusing on a third display frame at the time of white display, the operation of the chopper-type comparator unit 12 of Example 1 having the above-described configuration will be described with reference to a timing waveform diagram of FIG. 4.

As described above, the electric potential of the point "a" at the time of white display is mostly in the neighborhood of the inversion level (midpoint electric potential) of the CMOS inverter 31 of the first stage. In contrast, the first switching circuit (the p-channel-type field-effect transistor $TR_{17}$) of the control section 35 is in OFF state in a period in which the sawtooth-waveform voltage of the control pulse LCP exceeds the threshold voltage, and separates the CMOS inverter 31 of the first stage from the power supply $V_{dd}$, thereby allowing the comparator unit 12 to be in the non-operation state. This makes it possible to prevent a flow of a through current in the CMOS inverter 31 of the first stage, when it is not necessary to operate the comparator unit 12. It is to be noted that, as indicated by a broken line in FIG. 4, a through current flows through the field-effect transistors $TR_{11}$ and $TR_{12}$ of the CMOS inverter 31 of the first stage, when the comparator unit 12 is not allowed to be in the non-operation state.

Further, when the scanning signal provided through the scanning line SCL becomes at high level, the second switching circuit (the p-channel-type field-effect transistor $TR_{18}$) of the control section 35 becomes ON state, in response to an inversion signal of the scanning signal through the inverter 14. This causes the CMOS inverter 31 of the first stage to be connected to the power supply $V_{dd}$ on the high potential side through the second switching circuit (the p-channel-type field-effect transistor $TR_{18}$), thereby allowing the comparator unit 12 to be in the operation state. As a result, even in the high-level period of the control pulse LCP, the comparator unit 12 is allowed to be in the operation state reliably, when it is necessary to operate the comparator unit 12.

As described above, in Example 1, it is possible to allow the comparison section to be in the non-operation state based on the control pulse, when it is not necessary to operate the comparator unit. Therefore, it is possible to reduce a dark current or a through current flowing through the comparator unit, despite a simple circuit configuration.

Example 2

Figure 6:
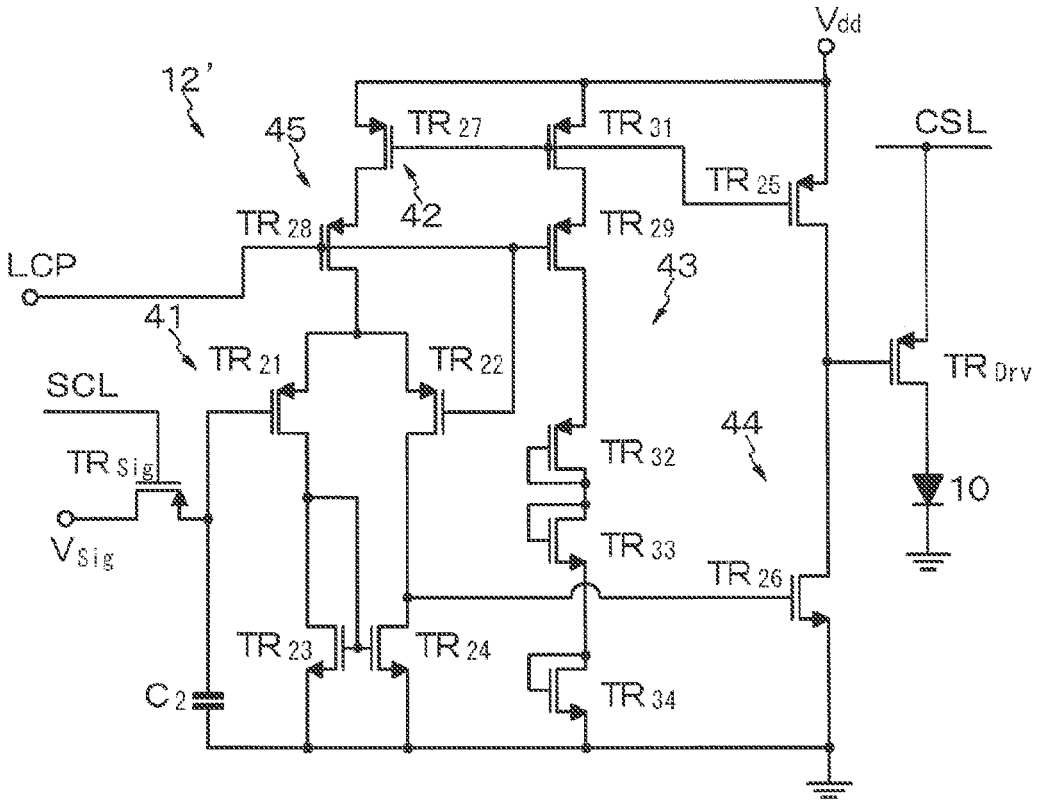
FIG. 6 is an equivalent circuit diagram of a pixel configured using a light-emission section and a drive circuit that includes a differential-type comparator unit in a display of Example 2.

Example 2 is a modification of Example 1. In Example 2, a comparator unit is configured using the comparator unit having the second configuration, and is configured of a differential-type comparator unit whose equivalent circuit diagram is illustrated in FIG. 6.

A differential-type comparator unit 12' in Example 2 includes a comparison section including a differential circuit 41 configured to receive the signal voltage $V_{Sig}$ and the control pulse LCP as two inputs, and the constant current source 42 configured to supply a constant current to the differential circuit 41.

The comparison section further includes the signal writing transistor $TR_{Sig}$ configured to receive the signal voltage (the emission intensity signal) $V_{Sig}$, and a capacity section $C_2$ connected to the signal writing transistor $TR_{Sig}$, and configured to retain, based on the operation of the signal writing transistor $TR_{Sig}$, an electric potential based on the signal voltage $V_{Sig}$.

In the differential-type comparator unit 12', the power supply $V_{dd}$ on the high potential side and a power supply on the low voltage side (the ground GND in Example 2) are each provided as an operation power supply.

The differential circuit 41 may be configured using, for example, p-channel-type field-effect transistors (a pair of differential transistors) $TR_{21}$ and $TR_{22}$, and n-channel-type field-effect transistors $TR_{23}$ and $TR_{24}$. The p-channel-type field-effect transistors $TR_{21}$ and $TR_{22}$ have source electrodes connected to each other, and perform differential operation. The n-channel-type field-effect transistors $TR_{23}$ and $TR_{24}$ are used to configure a current mirror circuit that becomes an active load.

A drain electrode and a gate electrode of the n-channel-type field-effect transistor $TR_{23}$ are both connected to a drain electrode of the p-channel-type field-effect transistor $TR_{21}$, and a source electrode of the n-channel-type field-effect transistor $TR_{23}$ is connected to the power supply GND on the low potential side. A gate electrode of the n-channel-type field-effect transistor $TR_{24}$ is connected to a gate electrode of the n-channel-type field-effect transistor $TR_{23}$, a drain electrode of the n-channel-type field-effect transistor $TR_{24}$ is connected to a drain electrode of the p-channel-type field-effect transistor $TR_{22}$, and a source electrode of the n-channel-type field-effect transistor $TR_{24}$ is connected to the power supply GND on the low potential side.

The signal voltage $V_{Sig}$ is taken in by the signal writing transistor $TR_{Sig}$, in response to the scanning signal provided from the scanning circuit 102 (see FIG. 2) through the scanning line SCL. In this example, a p-channel-type field-effect transistor is used as the signal writing transistor $TR_{Sig}$. The electric potential based on the signal voltage $V_{Sig}$ taken in by the signal writing transistor $TR_{Sig}$ is retained by the capacity section $C_2$.

The capacity section $C_2$ is connected between a gate electrode of the p-channel-type field-effect transistor $TR_{21}$ and the power supply GND on the low potential side. The electric potential based on the signal voltage $V_{Sig}$ retained by the capacity section $C_2$ is applied to the gate electrode of the p-channel-type field-effect transistor $TR_{21}$. Further, the control pulse LCP having a sawtooth-waveform voltage variation is applied to a gate electrode of the p-channel-type field-effect transistor $TR_{22}$.

The constant current source 42 may be configured using, for example, a p-channel-type field-effect transistor $TR_{27}$. The constant current source 42 supplies a constant current to the differential circuit 41, by application, of a constant voltage generated in a constant-voltage circuit 43, to a gate electrode of the p-channel-type field-effect transistor $TR_{27}$. The constant-voltage circuit 43 may be configured using, for example, p-channel-type field-effect transistors $TR_{31}$ and $TR_{32}$, and n-channel-type field-effect transistors $TR_{33}$ and $TR_{34}$, which are connected in series between the power supply $V_{dd}$ on the high potential side and the power supply GND on the low potential side. It is to be noted that each of the p-channel-type field-effect transistor $TR_{32}$ and the n-channel-type field-effect transistors $TR_{33}$ and $TR_{34}$ is in a diode-connection configuration in which a drain electrode thereof and a gate electrode thereof are connected to each other.

In the differential circuit 41, a common connecting point (node) between the drain electrode of the p-channel-type field-effect transistor $TR_{22}$ and the drain electrode of the n-channel-type field-effect transistor $TR_{24}$ serves as an output terminal (an output node). An input terminal of a common source circuit 44 is connected to this output terminal. The common source circuit 44 includes a p-channel-type field-effect transistor $TR_{25}$ and an n-channel-type field-effect transistor $TR_{26}$ that are connected in series between the power supply $V_{dd}$ on the high potential side and the power supply GND on the low potential side. A constant voltage is applied from the constant-voltage circuit 43 to a gate electrode of the field-effect transistor $TR_{25}$, and a gate electrode of the field-effect transistor $TR_{26}$ is connected to the output terminal of the differential circuit 41.

A common connecting point (node) between a drain electrode of the p-channel-type field-effect transistor $TR_{25}$ and a drain electrode of the n-channel-type field-effect transistor $TR_{26}$ serves as an output terminal (an output node) of the differential-type comparator unit of Example 2. The gate electrode of the light-emission-section driving transistor $TR_{Drv}$ is connected to this output terminal. When the first predetermined voltage (L) is outputted from the common source circuit 44, the light-emission-section driving transistor $TR_{Drv}$ becomes ON state, and supplies a current to the light-emission section 10. The light-emission section 10 is allowed to emit light, by being thus driven by the light-emission-section driving transistor $TR_{Drv}$.

As described above, in the case of the differential-type comparator unit of Example 2, a through current most of the time flows, because the constant current source 42 is used. Therefore, in Example 2, the comparator unit 12' includes a control section 45 that controls operation and non-operation of the comparison section having the differential circuit 41 and the constant current source 42, based on the control pulse LCP.

The control section 45 may include, for example, a p-channel-type field-effect transistor $TR_{28}$, as a switching circuit (which will be referred to as "third switching circuit" for convenience, to be distinguished from the switching circuit of the control section 35) that is connected in series to the constant current source 42. This switching circuit performs ON-OFF operation based on the sawtooth-waveform voltage of the control pulse LCP. When it is not necessary to operate the comparator unit, in other words, in the high-level period of the control pulse LCP, the p-channel-type field-effect transistor $TR_{28}$ used to configure the third switching circuit is in OFF state, and blocks a current supply path to the differential circuit 41.

In this example, there is adopted a configuration in which the p-channel-type field-effect transistor $TR_{28}$ used to configure the third switching circuit is inserted in series on the differential circuit 41 side, to the constant current source 42. However, it is also possible to adopt a configuration in which the p-channel-type field-effect transistor $TR_{28}$ is inserted in series on the power supply $V_{dd}$ side, to the constant current source 42.

The control section 45 may further include, for example, a p-channel-type field-effect transistor $TR_{29}$, as a second switching circuit (which will be referred to as "fourth switching circuit" for convenience, to be distinguished from the second switching circuit of the control section 35). This second switching circuit is connected in series to the constant-voltage circuit 43 that supplies a constant voltage to a gate electrode of the p-channel-type field-effect transistor $TR_{27}$ used to configure the constant current source 42. This second switching circuit performs ON-OFF operation based on the sawtooth-waveform voltage of the control pulse LCP. As with the p-channel-type field-effect transistor $TR_{28}$ used to configure the third switching circuit, the p-channel-type field-effect transistor $TR_{29}$ used to configure the fourth switching circuit is in OFF state in the high-level period of the control pulse LCP, and blocks a current supply path of the constant-voltage circuit 43.

In this way, also when the differential-type comparator unit is used as the comparator unit, it is possible to prevent a flow of a through current reliably, by blocking the current supply paths to the differential circuit 41 and the current supply path of the constant-voltage circuit 43, thereby allowing the comparator unit to be in a non-operation state, in the high-level period of the control pulse LCP.

Example 3

Figure 7:
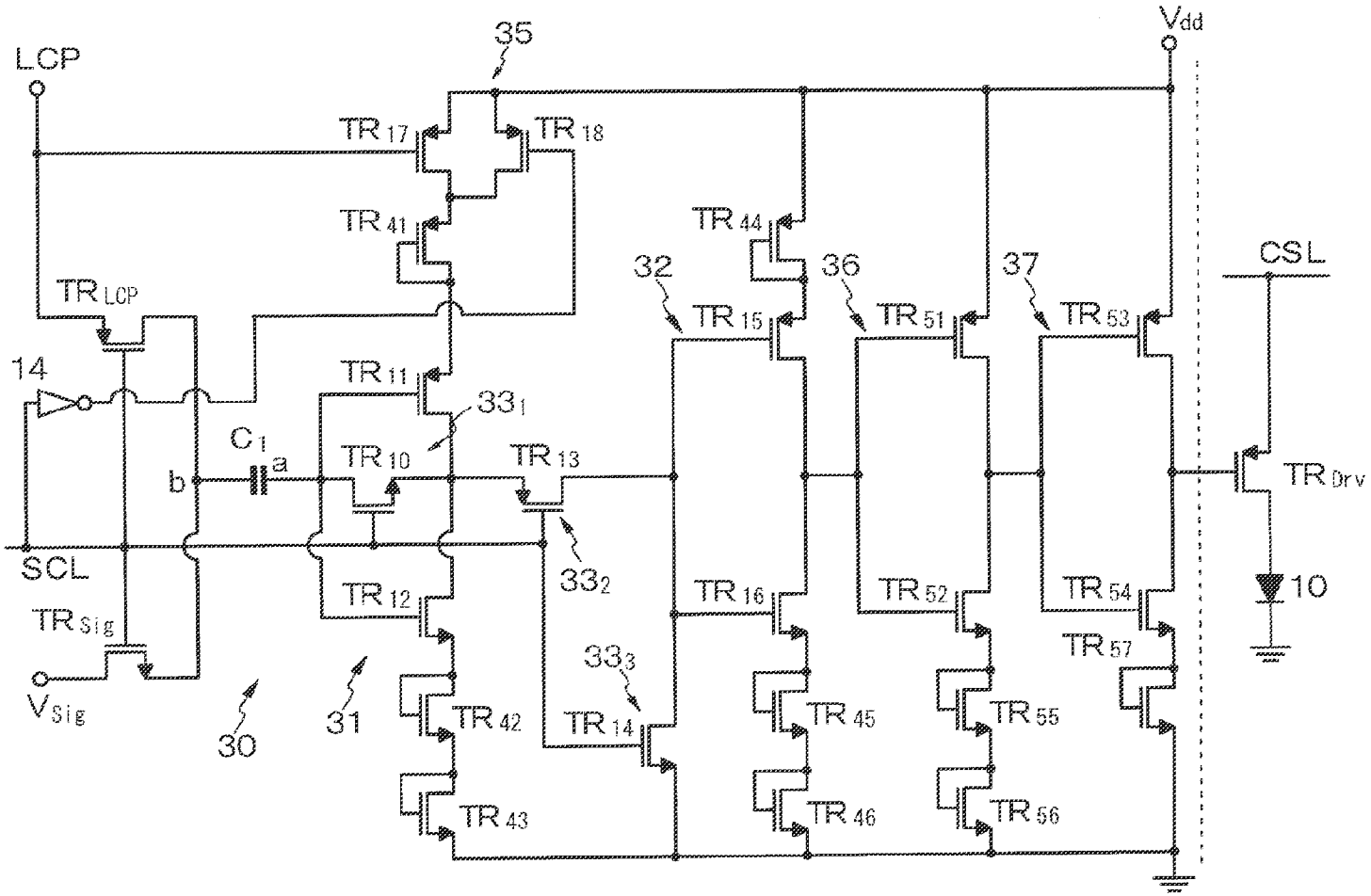
FIG. 7 is an equivalent circuit diagram of a pixel configured using a light-emission section and a drive circuit that includes a chopper-type comparator unit in a display of Example 3.

Example 3 is a modification of Example 1 or Example 2. In Example 3, the control section 35 includes a resistive element connected in series to the inverter circuit 30, in the chopper-type comparator unit of Example 1. This makes it possible to suppress a through current flowing in a period other than the high-level period of the control pulse, and therefore to reduce a dark current or a through current flowing through the drive circuit 11. Specifically, in Example 3, a chopper-type comparator unit whose equivalent circuit diagram is illustrated in FIG. 7 is used as the comparator unit.

In the chopper-type comparator unit of Example 3, a field-effect transistor having a diode-connection configuration in which a gate electrode and a drain electrode are connected to each other is used as a resistive element connected in series to the inverter circuit 30. As the resistive element, a diode element, a resistive element, etc. may be used, other than the field-effect transistor having the diode-connection configuration.

In the inverter circuit 30, a p-channel-type field-effect transistor $TR_{41}$ having a diode-connection configuration is connected in series, on the side where the power supply $V_{dd}$ on the high potential side is provided, to the CMOS inverter 31 of the first stage. On the side where the power supply GND on the low voltage side is provided, n-channel-type field-effect transistors $TR_{42}$ and $TR_{43}$ each having a diode-connection configuration are connected in series. Also with respect to the CMOS inverter 32 of the second stage, each of a p-channel-type field-effect transistor $TR_{44}$ having a diode-connection configuration and n-channel-type field-effect transistors $TR_{45}$ and $TR_{46}$ each having a diode-connection configuration is connected in series, in a manner similar to that of the first stage.

In this way, in the chopper-type comparator unit of Example 3, the resistive element is inserted in series with respect to the inverter circuit 30, and thereby a resistance value of the circuit is increased. This makes it possible to suppress a through current flowing in a period other than the high-level period of the control pulse, in particular, at the time of inversion operation, besides achieving functions and effects of Example 1. However, there is a concern that, when the resistance value of the circuit is increased, an output voltage of the inverter circuit 30 may not fully reach the power supply $V_{dd}$ or the power supply GND.

Therefore, in the chopper-type comparator unit of Example 3, for the inverter circuit 30, there may be adopted such a configuration that, for example, CMOS inverters 36 and 37 of two stages are added as inverters in stages subsequent to the CMOS inverter 32 of the second stage. The CMOS inverter 36 of the third stage is configured using a p-channel-type field-effect transistor $TR_{51}$ and an n-channel-type field-effect transistor $TR_{52}$ whose gate electrodes are connected to each other, and which are connected in series between the power supply $V_{dd}$ on the high potential side and the power supply GND on the low potential side. Likewise, the CMOS inverter 37 of the fourth stage is configured using a p-channel-type field-effect transistor $TR_{53}$ and an n-channel-type field-effect transistor $TR_{54}$ whose gate electrodes are connected to each other, and which are connected in series between the power supply $V_{dd}$ on the high potential side and the power supply GND on the low potential side.

In the chopper-type comparator unit of Example 3, a resistive element is inserted in series with respect to each of the CMOS inverters 36 and 37 of the third and fourth stages as well, thereby suppressing a through current flowing through the CMOS inverters 36 and 37 of the third and fourth stages. Specifically, with respect to the CMOS inverter 36 of the third stage, n-channel-type field-effect transistors $TR_{55}$ and $TR_{56}$ each having a diode-connection configuration are inserted in series as a resistive element, on the side where the power supply GND on the low voltage side is provided. Further, also with respect to the CMOS inverter 37 of the fourth stage, an n-channel-type field-effect transistor $TR_{57}$ having a diode-connection configuration is inserted in series as a resistive element, on the side where the power supply GND on the low voltage side is provided.

Example 4

Figure 8:
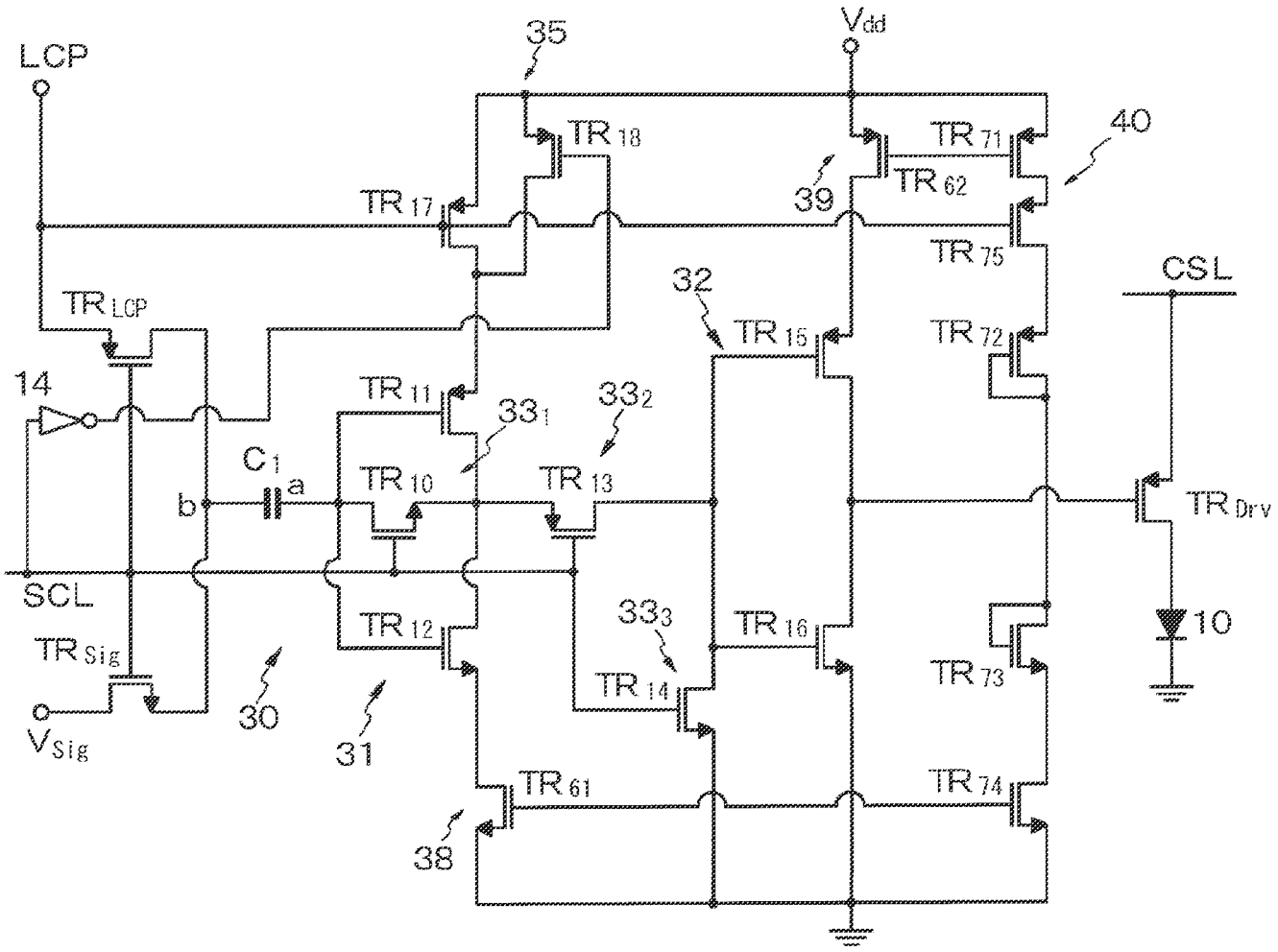
FIG. 8 is an equivalent circuit diagram of a pixel configured using a light-emission section and a drive circuit that includes a chopper-type comparator unit in a display of Example 4.

Example 4 is a modification of any of Examples 1 to 3. In Example 4, the control section 35 includes a constant current source connected in series to the inverter circuit 30 and suppressing (reducing) a current flowing through the inverter circuit 30, in the chopper-type comparator unit of Example 1. This suppresses a through current flowing in a period other than the high-level period of the control pulse, which makes it possible to further reduce a dark current or a through current flowing through the drive circuit 11. Specifically, in Example 4, a chopper-type comparator unit whose equivalent circuit diagram is illustrated in FIG. 8 is used as the comparator unit.

In the chopper-type comparator unit of Example 4, constant current sources 38 and 39 each having a reduced amount of current are provided for the CMOS inverter 31 of the first stage and the CMOS inverter 32 of the second stage, respectively. However, it is possible to achieve reasonable functions and effects, even by adopting a configuration in which the constant current source 38 or 39 having a reduced amount of current is provided for only either the CMOS inverter 31 of the first stage or the CMOS inverter 32 of second stage.

The constant current source 38 includes an n-channel-type field-effect transistor $TR_{61}$ connected between the n-channel-type field-effect transistor $TR_{12}$ and the power supply GND on the low potential side. The constant current source 39 includes a p-channel-type field-effect transistor $TR_{62}$ connected between the power supply $V_{dd}$ on the high potential side and the p-channel-type field-effect transistor $TR_{15}$. To a gate electrode of each of the constant current source transistors $TR_{61}$ and $TR_{62}$, a constant voltage is applied from a constant-voltage circuit 40.

The constant-voltage circuit 40 includes p-channel-type field-effect transistors $TR_{71}$ and $TR_{72}$ and n-channel-type field-effect transistors $TR_{73}$ and $TR_{74}$, which are connected in series between the power supply $V_{dd}$ on the high potential side and the power supply GND on the low potential side. The p-channel-type field-effect transistor $TR_{72}$ and the n-channel-type field-effect transistor $TR_{73}$ each have a diode-connection configuration in which a gate electrode and a drain electrode are connected to each other. The constant-voltage circuit 40 further includes a p-channel-type field-effect transistor $TR_{75}$ connected in series within the circuit. The p-channel-type field-effect transistor $TR_{75}$ performs ON-OFF operation according to the sawtooth-waveform voltage of the control pulse. To be more specific, the p-channel-type field-effect transistor $TR_{75}$ allows the constant-voltage circuit 40 to operate, by becoming ON state in a low-level period (a period in which the sawtooth-waveform voltage is equal to or lower than the threshold voltage) of the control pulse. As a result, a constant voltage is applied from the constant-voltage circuit 40 to the gate electrode of each of the constant current source transistors $TR_{61}$ and $TR_{62}$, and a current in accordance with this voltage is supplied to the CMOS inverters 32 and 33 of the first and second stages.

In this way, the constant current sources 38 and 39 are connected in series to the inverter circuit 30, and the amount of current in each of the constant current sources 38 and 39 is reduced (suppressed/decreased) in accordance with the voltage applied by the constant-voltage circuit 40. This makes it possible to suppress a through current flowing in a period other than the high-level period of the control pulse, in particular, at the time of inversion operation, besides achieving the functions and effects of Example 1.

Figure 9:
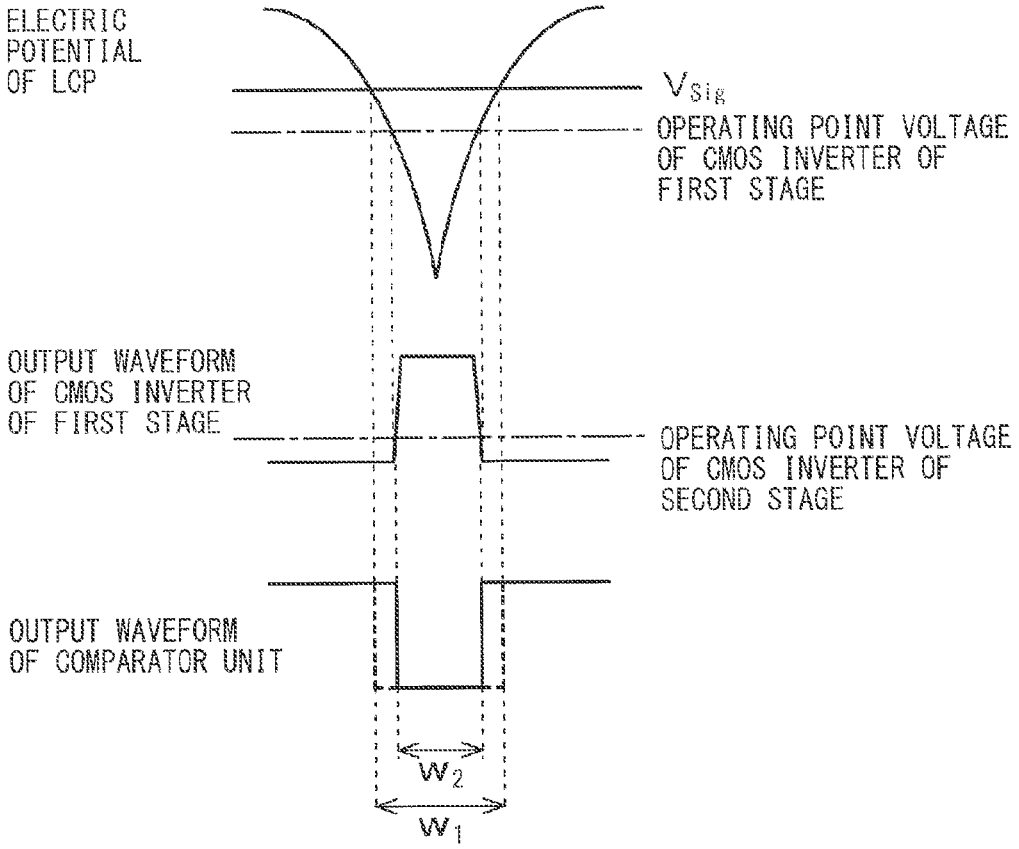
FIG. 9 is a waveform chart used to describe one of functions and effects of the chopper-type comparator unit in the display of Example 4.

Moreover, there is adopted such a configuration that the constant current source 38 is disposed on the power supply GND side with respect to the CMOS inverter 31 of the first stage, and the constant current source 39 is disposed on the power supply $V_{dd}$ side with respect to the CMOS inverter 32 of the second stage. Therefore, operating point voltages of the CMOS inverters 32 and 33 of the first and second stages are made different. This allows the following function and effect to be obtained. That is, due to the difference between the operating point voltages of the CMOS inverters 32 and 33 of the first and second stages, it is possible to make a pulse width $w_2$ of the output voltage of the comparator unit become smaller than a time interval $w_1$ during which the control pulse is cut off by the emission intensity signal $V_{Sig}$, as illustrated in a waveform chart of FIG. 9. This means that it is not necessary to make the tip of the waveform of the control pulse temporally too fine. In other words, in order to obtain the output voltage of the comparator unit with the pulse width $w_1$, it may only be necessary to generate a control pulse whose tip of a waveform is wider than that of the control pulse illustrated in FIG. 9. In this way, a control pulse in a waveform with a wide tip is allowed to be generated. Therefore, there is such an advantage that waveform dullness, which will be described later, due to impedance of the control pulse line PSL transmitting the control pulse, occurs less easily.

It is to be noted that, corresponding to the control pulse that causes an active state at low level, the constant current sources 38 and 39 are disposed on the power supply GND side with respect to the CMOS inverter 31 of the first stage, and on the power supply $V_{dd}$ side with respect to the CMOS inverter 32 of the second stage, respectively, of the inverter circuit 30. However, in a case of the control pulse of an active state at high level, the constant current sources 38 and 39 may be disposed on the power supply $V_{dd}$ side with respect to the CMOS inverter 31 of the first stage, and on the power supply GND side with respect to the CMOS inverter 32 of the second stage, respectively.

Example 5

Figure 10:
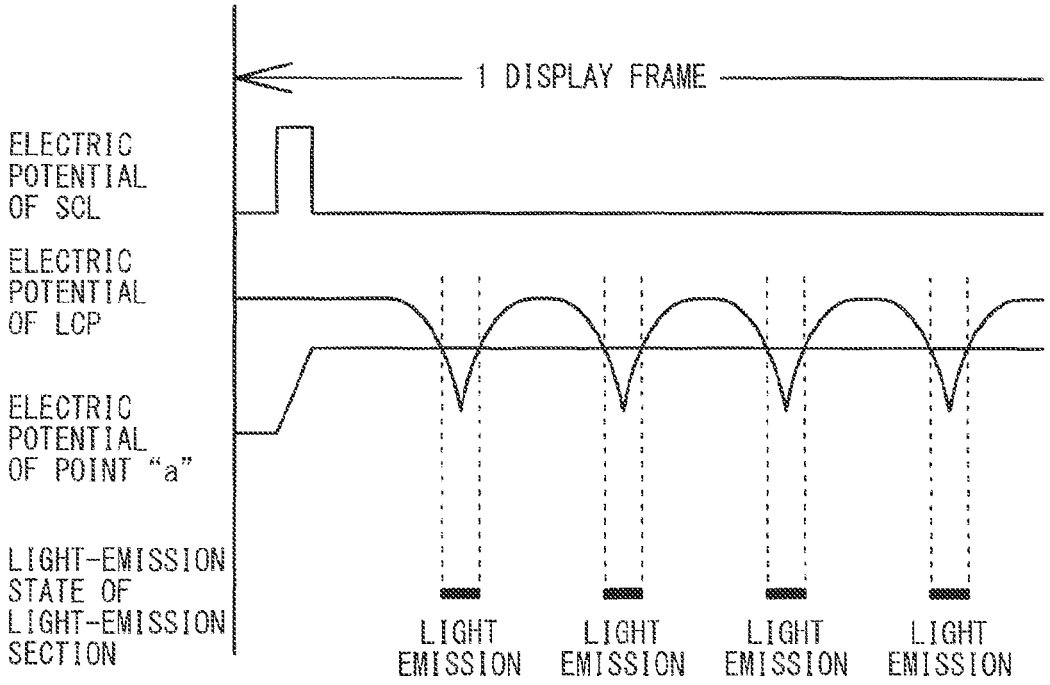
FIG. 10 is a schematic diagram illustrating a control pulse and the like, used to describe operation of one pixel in a display of Example 5.
Figure 11:
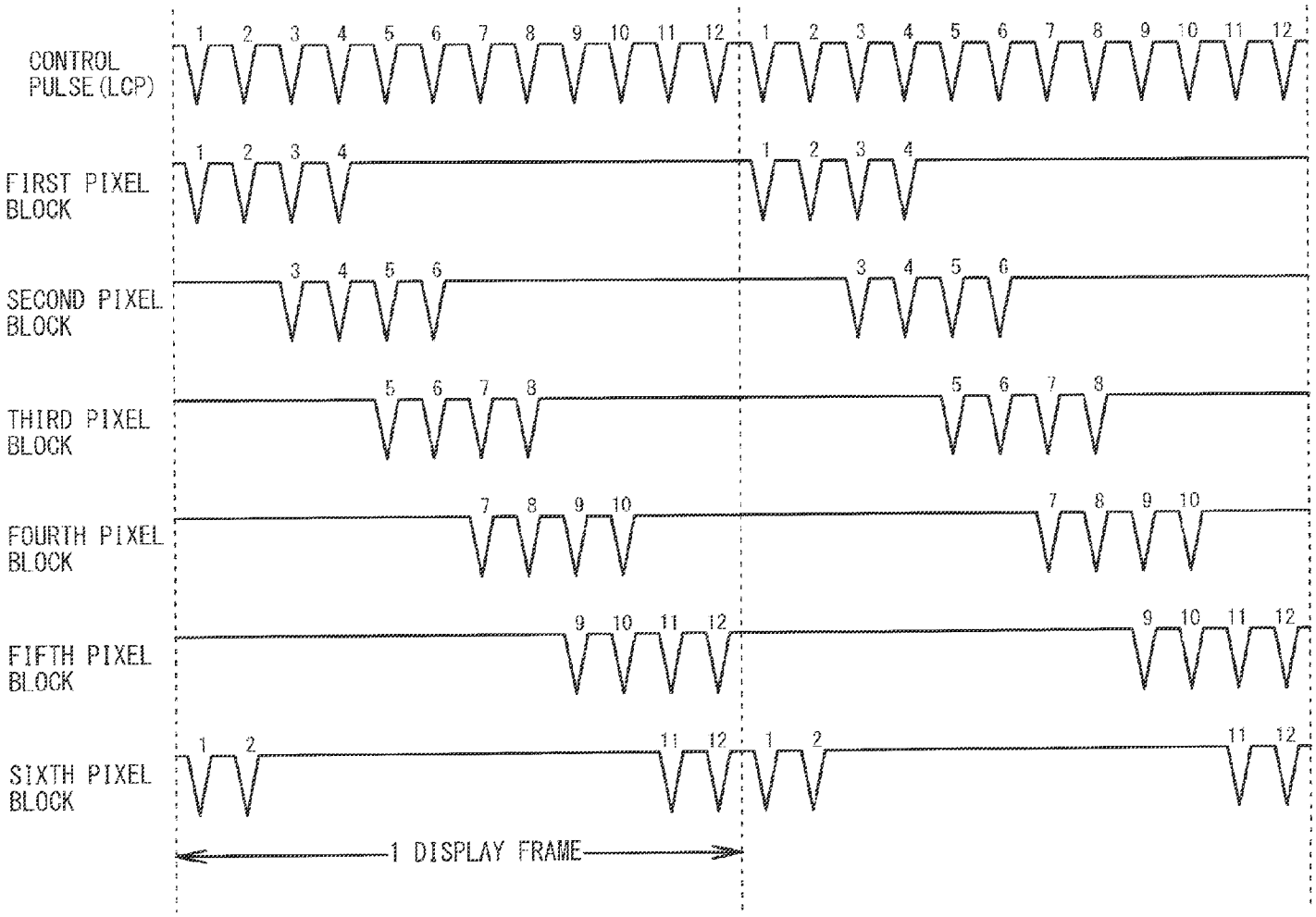
FIG. 11 is a diagram schematically illustrating supply of a plurality of control pulses to pixel blocks in the display of Example 5.
Figure 12:
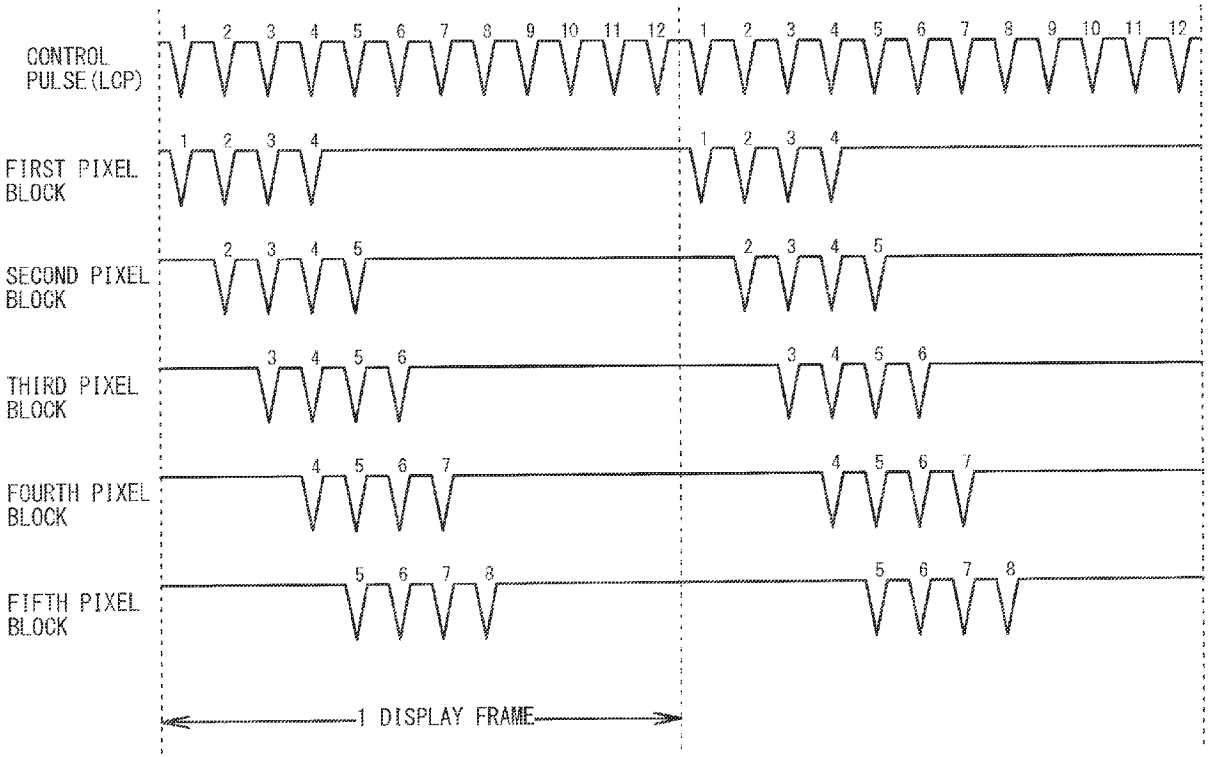
FIG. 12 is a diagram schematically illustrating supply of a plurality of control pulses to pixel blocks in a modification of the display of Example 5.
Figure 14A:
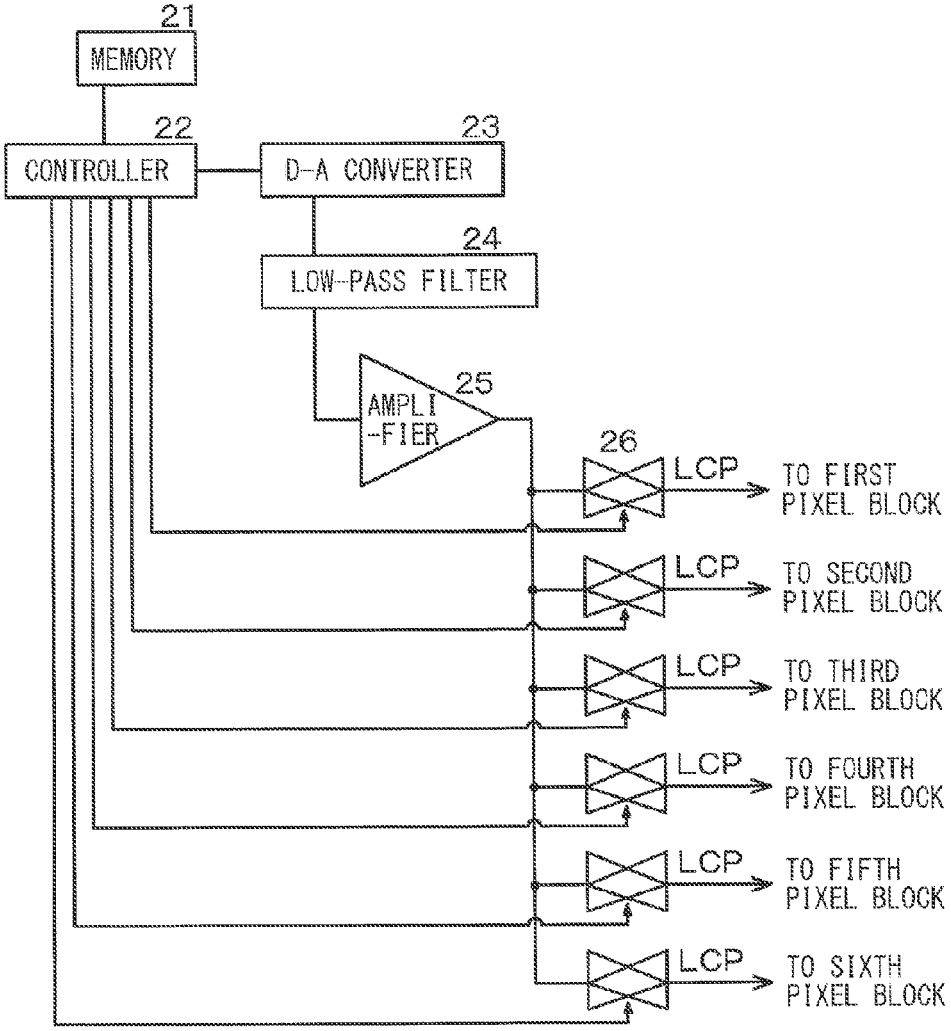
FIGS. 14A and 14B are a conceptual diagram of a control-pulse generation circuit in a display according to an embodiment of the present disclosure, and a circuit diagram of a voltage follower circuit (a buffer circuit) in the display of Example 6, respectively.

Example 5 is a modification of any of Examples 1 to 4. FIG. 10 illustrates a schematic diagram illustrating a control pulse and the like used to describe operation of one pixel in a display of Example 5. Further, FIG. 11 schematically illustrates supply of a plurality of control pulses to a pixel block in the display of Example 5. Furthermore, FIG. 14A illustrates a conceptual diagram of the control-pulse generation circuit in a display according to an embodiment of the present disclosure. In FIG. 11 and FIG. 12 to be described later, the sawtooth waveform of the control pulse is indicated by triangles for convenience.

In the display of Example 5, or a display in a method of driving the display in Example 5, the plurality of pixels 1, each including the light-emission section 10 and the drive circuit 11 that drives the light emission section 10, are arranged in the two-dimensional matrix in the first direction and the second direction. The pixel group is divided into P-number of pixel blocks in the first direction. From the light-emission sections 10 of the pixels 1 belonging to the first pixel block to the light-emission sections 10 of the pixels 1 belonging to the Pth pixel block, the light-emission sections 10 are allowed to emit light simultaneously, which is performed sequentially on a pixel block basis. In addition, when the light-emission sections 10 of the pixels 1 belonging to part of the pixel blocks are allowed to emit light, the light-emission sections 10 of the pixels 1 belonging to the remaining pixel blocks are not allowed to emit light.

For example, it is supposed that there may be a full-HD full color display in which the number of pixels in the horizontal direction (the second direction) of the screen is 1920, and the number of pixels in the vertical direction (the first direction) of the screen is 1080. The pixel group is divided into the P-number of pixel blocks in the first direction, and P is assumed to be 6. In this case, a first pixel block includes a pixel group in a first row to a pixel group in a 180th row. A second pixel block includes a pixel group in a 181th row to a pixel group in a 360th row. A third pixel block includes a pixel group in a 361th row to a pixel group in a 540th row. A fourth pixel block includes a pixel group in a 541th row to a pixel group in a 720th row. A fifth pixel block includes a pixel group in a 721th row to a pixel group in a 900th row. A six pixel block includes a pixel group in a 901th row to a pixel group in a 1080th row.

Operation of each pixel in the first pixel block will be described below.

[Signal-Voltage Writing Period]

As described in Example 1 to Example 4, the electric charge in accordance with the electric potential of the data line DTL, namely the electric potential based on the signal voltage $V_{Sig}$, is accumulated in each of the capacity sections $C_1$ and $C_2$. In other words, the capacity sections $C_1$ and $C_2$ each retain the electric potential based on the signal voltage $V_{Sig}$. In this example, in the first pixel block, the drive circuits 11 (specifically, the signal writing transistors $TR_{Sig}$) in all of the pixels belonging to one line arranged in the second direction (a row-direction pixel group) are allowed to be in the operation state simultaneously. Further, in the first pixel block, the operation, in which the drive circuits 11 (specifically, the signal writing transistors $TR_{Sig}$) in all of the pixels belonging to one line arranged in the second direction (the row-direction pixel group) are allowed to be in the operation state simultaneously, is sequentially performed from the drive circuits 11 (specifically, the signal writing transistors $TR_{Sig}$) in all of the pixels belonging to the first row in the first direction (the row-direction pixel group in the first row) to the drive circuits 11 (specifically, the signal writing transistors $TR_{Sig}$) in all of the pixels belonging to the last row (specifically, the 180th row) (the row-direction pixel group in the last row).

[Pixel-Block Light Emission Period]

When the above-described operation is completed in the first pixel block, the control pulse LCP is supplied from the control-pulse generation circuit 103 to the first pixel block. In other words, the drive circuits 11 (specifically, the light-emission-section driving transistors $TR_{Drv}$) of all of the pixels 1 in the first pixel block are caused to be in the operation state simultaneously, and the light-emission sections 10 in all of the pixels 1 belonging to the first pixel block are allowed to emit light. The absolute value of the voltage of the one control pulse LCP increases, and then decreases, over time. It is to be noted that, in the example illustrated in FIG. 10, the voltage of the one control pulse LCP decreases, and then increases over time. Gamma correction is performed based on the voltage of the control pulse LCP that varies over time. In other words, the absolute value of a variation rate (a derivative value) of the voltage of the control pulse LCP in which time is a variable is proportional to a constant 2.2.

In the example illustrated in FIG. 10, during a signal-voltage writing period, the voltage of the control pulse LCP may be, for example, 3 volts or higher. Therefore, during the signal-voltage writing period, because the comparator unit 12 or 12' outputs a second predetermined voltage (H) from an output section, the light-emission-section driving transistor $TR_{Drv}$ is in OFF state. During a pixel-block light emission period, when the voltage of the control pulse LCP begins to drop, and the sawtooth-waveform voltage of the control pulse LCP becomes equal to or lower than the electric potential based on the signal voltage $V_{Sig}$, the comparator unit 12 or 12' outputs the first predetermined voltage (L) from the output section. As a result, the light-emission-section driving transistor $TR_{Drv}$ becomes ON state, a current is supplied from the current supply line CSL to the light-emission section 10, and the light-emission section 10 emits light. The voltage of the control pulse LCP falls to about 1 volt, and then rises. When the sawtooth-waveform voltage of the control pulse LCP exceeds the electric potential based on the signal voltage $V_{Sig}$, the comparator unit 12 or 12' outputs the second predetermined voltage (H) from the output section. As a result, the light-emission-section driving transistor $TR_{Drv}$ becomes OFF state, and the supply of the current from the current supply line CSL to the light-emission section 10 is blocked, which causes the light-emission section 10 to stop emitting the light. In other words, the light-emission section 10 is allowed to emit light only during the time period in which the sawtooth waveform of the control pulse LCP is cut off by the electric potential based on the signal voltage (the emission intensity signal) $V_{Sig}$. Luminance of the light-emission section 10 in this case depends on the length of the cut-off time.

In other words, the time period during which the light-emission section 10 emits light is based on the electric potential retained by each of the capacity sections $C_1$ and $C_2$, and the voltage of the control pulse LCP from the control-pulse generation circuit 103. The gamma correction is performed based on the sawtooth-waveform voltage of the control pulse LCP that varies over time. In other words, the absolute value of the variation rate of the voltage of the control pulse LCP in which the time is a variable is proportional to the constant 2.2, and therefore, it is not necessary to provide a circuit for the gamma correction. For example, it is conceivable to adopt a method in which a control pulse having a voltage of a linear sawtooth waveform (a triangular waveform) is used, and the signal voltage $V_{Sig}$ is varied by being raised to the 2.2th power with respect to a linear luminance signal. Actually, however, a voltage variation becomes too small at low luminance, and in particular, in order to achieve such a voltage variation by digital processing, a large bit number is necessary. Therefore, it is difficult to say that this is an effective method.

In Example 5, the one control-pulse generation circuit 103 is provided. As schematically illustrated in FIG. 10, the variation in the voltage of the control pulse LCP is considerably steep at a low gray-scale part (a low voltage part), and is sensitive to waveform quality of the control pulse waveform of this part, in particular. Therefore, it is necessary to consider variation in the control pulse LCP generated in the control-pulse generation circuit. In the display of Example 5, however, variations are not caused substantially in the control pulse LCP generated in the control-pulse generation circuit, because only one control-pulse generation circuit 103 is provided. In other words, light is allowed to be emitted in the entire display by the same control pulse waveform, and therefore it is possible to prevent occurrence of variations in the emission state. In addition, the absolute value of the voltage of the control pulse LCP increases, and then decreases, over time. Therefore, it is possible to allow the light-emission sections of all of the pixels (specifically, all of the sub-pixels) belonging to one pixel block to emit light at the same timing. In other words, temporal centers of gravity of light emission of the light-emission sections in all of the pixels belonging to each pixel block are allowed to be synchronized (agree) with one another. Therefore, it is possible to reliably prevent generation of a vertical line (a vertical streak) on an image due to a delay in light emission in a column-direction pixel group.

In the display and the method of driving the same of Example 5, the light-emission section 10 emits light a plurality of times, based on the plurality of control pulses LCP. Alternatively, the light-emission section 10 emits light a plurality of times, based on the plurality of control pulses LCP each having the sawtooth-waveform voltage variation supplied to the drive circuit 11, and the electric potential based on the signal voltage $V_{Sig}$. Still alternatively, in the control-pulse generation circuit 103, the light-emission section 10 is allowed to emit light a plurality of times, based on the plurality of control pulses LCP. A time interval between the plurality of control pulses LCP is constant. Specifically, in Example 5, in the pixel-block light emission period, the four control pulses LCP are sent to all of the pixels 1 of each pixel block, and each of the pixels 1 emits light four times.

In the display and the method of driving the same of Example 5, as schematically illustrated in FIG. 11, the twelve control pulses LCP are supplied to the six pixel blocks in one display frame. The number of control pulses LCP supplied to the drive circuits 11 in one display frame is smaller than the number of control pulses LCP in one display frame. Alternatively, in the control-pulse generation circuit 103, the number of control pulses LCP supplied to the drive circuits 11 in one display frame is smaller than the number of control pulses LCP in one display frame. Specifically, in the example illustrated in FIG. 11, the number of control pulses LCP in one display frame is 12, and the number of control pulses LCP supplied to the drive circuits 11 in one display frame is 4. In adjacent pixel blocks, the two control pulses LCP of one pixel block overlaps those of the other pixel block. In other words, the adjacent two pixel blocks are in the light-emission state at the same time. Further, the first pixel block and the last pixel block are also in the emission state at the same time. Such a configuration may be achieved by, when a series of a plurality of control pulses LCP are generated in one display frame, and the light-emission sections 10 of the pixels 1 belonging to one pixel block are not allowed to emit light, masking part of the series of the plurality of control pulses LCP, not to supply the control pulses LCP to the drive circuits 11 of the pixels 1 belonging to the one pixel block. Specifically, for example, using a multiplexer, the part (the four consecutive control pulses LCP) of the series of control pulses LCP may be extracted from the series of control pulses LCP in one display frame, and then supplied to the drive circuit 11.

In other words, the control-pulse generation circuit 103 of Example 5 is a control-pulse generation circuit that generates the control pulse LCP having the sawtooth-waveform voltage variation, to control the drive circuit 11 in the display configured as follows. In this display, the plurality of pixels 1 are arranged in a two-dimensional matrix in the first direction and the second direction, each of the plurality of pixels 1 includes the light-emission section 10, and the drive circuit 11 that allows the light emission-section 10 to emit light only for the time period in accordance with the electric potential based on the signal voltage $V_{Sig}$. In this display, the pixel group is divided into the P-number of pixel blocks in the first direction. The control-pulse generation circuit 103 simultaneously supplies the control pulses LCP to the drive circuits 11 on a pixel block basis, sequentially from the drive circuits 11 of the pixels 1 belonging to the first pixel block to the drive circuits 11 of the pixels 1 belonging to the Pth pixel block. In addition, when supplying the control pulses LCP to the drive circuits 11 of the pixels 1 belonging to part of the pixel blocks, the control-pulse generation circuit 103 does not supply the control pulses LCP to the drive circuits 11 of the pixels 1 belonging to the remaining pixel blocks. In this example, in the control-pulse generation circuit 103, when the series of the plurality of control pulses LCP are generated in one display frame, and the light-emission sections 10 of the pixels 1 belonging to one pixel block are not allowed to emit light, part of the series of the plurality of control pulses LCP is masked, not to supply the control pulses LCP to the drive circuits 11 of the pixels 1 belonging to the one pixel block.

To be more specific, as illustrated in the conceptual diagram of FIG. 14A, in the control-pulse generation circuit 103, waveform signal data of a control pulse stored in a memory 21 is read by a controller 22, and the read waveform signal data is sent to a D-A converter 23 to be converted into a voltage in the D-A converter 23. The obtained voltage is integrated in a low-pass filter 24 to create a control pulse having the 2.2th-power curve. The control pulse is then distributed to a plurality of (six, in Example 5) multiplexers 26 through an amplifier 25. Subsequently, under the control of the controller 22, only necessary part of the series of control pulses LCP is allowed to pass and the remaining part is masked by the multiplexers 26, to create a desirable control pulse group (specifically, six sets of control pulse groups each including four consecutive control pulses LCP). It is to be noted that the original sawtooth waveform is one, and therefore, it is possible to reliably suppress occurrence of variations in generation of the control pulses LCP in the control-pulse generation circuit 103.

Subsequently, the above-described operation performed during the signal-voltage writing period and the pixel-block light emission period is sequentially performed from the first pixel block to the sixth pixel block. In other words, as illustrated in FIG. 11, from the light-emission sections 10 of the pixels 1 belonging to the first pixel block to the light-emission sections 10 of the pixels 1 belonging to the Pth pixel block, the light-emission sections 10 are allowed to emit light simultaneously, which is performed sequentially on a pixel block basis. In addition, when the light-emission sections 10 of the pixels 1 belonging to part of the pixel blocks are allowed to emit light, the light-emission sections 10 of the pixels 1 belonging to the remaining pixel blocks are not allowed to emit light. It is to be noted that, in one display frame, light is emitted most of the time by any of the pixel blocks.

Meanwhile, in a currently-available driving method, image signal voltages are written to all pixels, in a state in which light emission of all the pixels is stopped, during a first period at the beginning of one display frame period. During a second period, emission-sections of all the pixels are allowed to emit light, within at least one light emission period that is determined by the image signal voltages written to the respective pixels. This driving method has the following disadvantage. That is, in many cases, image signals are sent uniformly, over the full time period of one display frame. Therefore, in a television receiver system, it is conceivable to adopt a method of causing all pixels to emit light at the same time, if a vertical blanking period is applied to the second period. However, the vertical blanking period usually has a time length of about 4% of one display frame. Therefore, a display having considerably-low luminous efficiency is obtained. In addition, in order to write image signals sent over one display frame, in all the pixels during the first period, it is necessary to prepare a large signal buffer. In addition, in order to transmit an image signal to each pixel at a speed higher than a transfer rate of an arriving image signal, it is necessary to devise a technique for a signal transmission circuit. Moreover, there is such a disadvantage that, because all the pixels are allowed to emit light simultaneously during the second period, electric power necessary for the light emission is concentrated in a short time, which complicates a power supply design.

In contrast, in Example 5, when the light-emission sections of the pixels belonging to part of the pixel blocks (for example, the first and second pixel blocks) are allowed to emit light, the light-emission sections of the pixels belonging to the remaining pixel blocks (for example, the third to sixth pixel blocks) are not allowed to emit light. Therefore, in driving of a display based on a PWM driving method, it is possible to increase a light emission period, and an improvement in luminous efficiency is achievable. In addition, it is not necessary to write the image signals sent over one display frame in all the pixels simultaneously within a certain period. In other words, as with a currently-available display, it is only necessary to write the image signals sent over one display frame, sequentially on a row-direction pixel group basis. Therefore, it is not necessary to prepare a large signal buffer, and it is not necessary to devise a technique for a signal transmission circuit to be used to transmit an image signal to each pixel at a speed higher than a transfer rate of an arriving image signal, either. In addition, not all the pixels are allowed to emit light simultaneously during the light emission period of the pixels. In other words, for example, when the light-emission sections of the pixels belonging to the first and second pixel blocks are allowed to emit light, the light-emission sections of the pixels belonging to the third to sixth pixel blocks are not allowed to emit light. Therefore, electric power necessary for the light emission is not concentrated in a short time, and consequently, a power supply design is readily achieved.

FIG. 12 schematically illustrates supply of the plurality of control pulses LCP to the pixel blocks in the modification of the display of Example 5, and in this example, P is 5. In other words, a first pixel block includes a pixel group in a first row to a pixel group in a 216th row. A second pixel block includes a pixel group in a 217th row to a pixel group in a 432th row. A third pixel block includes a pixel group in a 433th row to a pixel group in a 648th row. A fourth pixel block includes a pixel group in a 649th row to a pixel group in an 864th row. A fifth pixel block includes a pixel group in an 865th row to a pixel group in a 1080th row.

Also, in the example illustrated in FIG. 12, during a pixel-block light emission period, the four control pulses LCP are sent to all the pixels 1 of each pixel block, and each of the pixels 1 emits light four times. In one display frame, twelve control pulses LCP are supplied to six pixel blocks. The number of control pulses LCP supplied to the drive circuits 11 in one display frame is smaller than the number of control pulses LCP in one display frame. Specifically, in the example illustrated in FIG. 12, likewise, the number of control pulses LCP in one display frame is 12, and the number of control pulses LCP supplied to the drive circuits 11 in one display frame is 4. However, unlike the example illustrated in FIG. 11, the pixel block emitting no light is present in one display frame. In adjacent pixel blocks, the three control pulses LCP of one pixel block overlaps those of the other pixel block. In the five pixel blocks, the emission states in four pixel blocks at the maximum overlap one another. In this way, more pixel blocks than those of the example illustrated in FIG. 11 are allowed to emit light at the same time. Therefore, it is possible to further improve the image display quality.

Example 6

Example 6 is a modification of any of Examples 1 to 5. Incidentally, the control pulse LCP is transferred or transmitted through the control pulse line PSL which is a long-distance wiring line. In the control pulse line PSL, there is impedance such as resistance, capacity, and reactance component. Therefore, the longer the transmission distance is, the more easily the waveform dullness occurs. In particular, in the control pulse LCP, waveform bluntness more easily occurs at a lower voltage part illustrated in FIG. 10. The pixel located farther from a control-pulse input terminal of the control pulse line PSL is expected to have shading in which low gray-scale becomes black. Providing a control pulse line PSL with small impedance is an effective measure to evade such a disadvantage. However, constraints in terms of manufacturing as well as manufacturing cost are strong, and the larger the screen size of a display is, the more difficult it is to take such a measure.

Figure 14B:
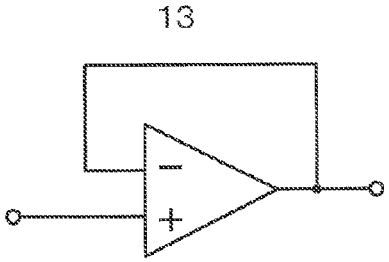

In the display of Example 6, as illustrated in a conceptual diagram of a circuit used to configure the display in FIG. 13, voltage follower circuits (buffer circuits) 13 are disposed at a predetermined distance in between (for every predetermined number of pixels), in the control pulse line PSL. It is to be noted that all of the pixels belonging to one line arranged in the second direction are connected to the control pulse line PSL. FIG. 14B illustrates a circuit diagram of the voltage follower circuit (the buffer circuit) 13. With such a configuration, waveform shaping of the control pulse LCP transmitted through the control pulse line PSL is performed, and waveform dullness less easily occurs. In other words, it is possible to minimize deterioration of the sawtooth waveform due to the impedance of the control pulse line PSL. For example, one voltage follower circuit 13 may be disposed for ten to twenty pixels belonging to one line in the second direction (pixels arranged in the row direction). Except for the above-described points, the configuration and the structure of the display of Example 6 may be similar to those of the displays described in Examples 1 to 5, and therefore, the detailed description thereof will be omitted.

The present disclosure has been described above with reference to some preferable Examples, but the present disclosure is not limited to these Examples. The configurations and the structures of the displays, as well as various circuits included in the light-emission sections, the drive circuits, and the displays described in the Examples are provided as examples, and may be modified as appropriate. In the Examples, the signal writing transistors are of n-channel type, and the light-emission-section driving transistors are of p-channel type. However, the conductivity types of the channel forming regions of the transistors are not limited to these types, and the waveforms of the control pulses are not limited to the waveforms described in the Examples, either. In addition, in the Examples, the n-channel-type transistor or p-channel-type transistor is used as each of the switch section and the switching circuit. However, the conductivity type of the channel forming region of the transistor used as each of the switch section and the switching circuit may be of an opposite type. Alternatively, a transfer switch in which an n-channel-type transistor and a p-channel-type transistor are connected in parallel may be used.

Moreover, in the Examples, an embodiment according to the technique of the present disclosure is applied to the comparator unit used to configure the drive circuit of the pixel of the display, but is not limited thereto. An embodiment according to the technique of the present disclosure may be applied to all kinds of comparator units (comparator circuits) that compare a sawtooth-waveform voltage of a control pulse having a sawtooth-waveform voltage variation, with an electric potential based on a signal voltage.

It is possible to achieve at least the following configurations from the above-described example embodiments and the modifications of the disclosure.

[A01] (Comparator Unit)

A comparator unit including:

a comparison section configured to compare a control pulse with an electric potential based on a signal voltage; and a control section configured to control, based on the control pulse, operation and non-operation of the comparison section.

[A02] (Comparator Unit: First Configuration)

The comparator unit according to [A01], wherein the comparison section includes a signal writing transistor configured to receive the signal voltage, a control-pulse transistor configured to receive the control pulse, and configured to perform ON-OFF operation based on a signal of a phase opposite to a phase of a signal used by the signal writing transistor, an inverter circuit, and a capacity section having a first end and a second end, and configured to retain, based on operation of the signal writing transistor, the electric potential based on the signal voltage, the first end being connected to the signal writing transistor and the control-pulse transistor, and the second end being connected to the inverter circuit.

[A03] The comparator unit according to [A02], wherein the control pulse has sawtooth-waveform voltage variation, and the control section includes a first switching circuit connected in series to the inverter circuit, and configured to perform ON-OFF operation based on the sawtooth-waveform voltage variation of the control pulse.

[A04] The comparator unit according to [A03], wherein the control section includes a second switching circuit connected in parallel to the first switching circuit, and configured to be in an ON state during an operation period of the comparator unit.

[A05] The comparator unit according to [A03] or [A04], wherein the control section includes a resistive element connected in series to the inverter circuit.

[A06] The comparator unit according to any one of [A03] to [A05], wherein the control section includes a constant current source connected in series to the inverter circuit, and configured to suppress a current flowing through the inverter circuit.

[A07] The comparator unit according to [A06], wherein the inverter circuit includes inverters in two-or-more-stage cascade connection, and the constant current source is connected to the inverter of a first stage on a side, with respect to the inverter of the first stage, where one of a power supply on high potential side and a power supply on low potential side is provided, and the constant current source is connected to the inverter of a second stage on a side, with respect to the inverter of the second stage, where the other of the power supply on the high potential side and the power supply on the low potential side is provided.

[A08] (Comparator Unit: Second Configuration)

The comparator unit according to [A01], wherein the comparison section includes a differential circuit configured to receive the signal voltage and the control pulse as two inputs, and a constant current source configured to supply a constant current to the differential circuit.

[A09] The comparator unit according to [A08], wherein the comparison section further includes a signal writing transistor configured to receive the signal voltage, and a capacity section connected to the signal writing transistor, and configured to retain, based on operation of the signal writing transistor, the electric potential based on the signal voltage.

[A10] The comparator unit according to [A08] or [A09], wherein the control pulse has sawtooth-waveform voltage variation, and the control section includes a third switching circuit connected in series to the constant current source, and configured to perform ON-OFF operation based on the sawtooth-waveform voltage variation of the control pulse.

[A11] The comparator unit according to [A10], wherein the control section includes a second switching circuit connected in series to a constant-voltage circuit, and configured to perform ON-OFF operation based on the sawtooth-waveform voltage variation of the control pulse, the constant-voltage circuit being configured to apply a constant voltage to a gate electrode of a transistor configuring the constant current source.

[B01] (Display)

A display including a plurality of pixels arranged in a two-dimensional matrix, the pixels each including a light-emission section and a drive circuit configured to drive the light-emission section, the drive section including a comparator unit configured to compare a control pulse with an electric potential based on a signal voltage, and to output a predetermined voltage based on a comparison result, and a light-emission-section driving transistor configured to supply a current to the light-emission section in response to the predetermined voltage from the comparator unit, thereby allowing the light-emission section to emit light, and the comparator unit including a comparison section configured to compare a control pulse with an electric potential based on a signal voltage, and a control section configured to control, based on the control pulse, operation and non-operation of the comparison section.

[B02] The display according to [B01], wherein the plurality of pixels are arranged in a two-dimensional matrix in a first direction and a second direction, and are divided into a P-number of pixel blocks in the first direction, and the light-emission sections configuring pixels belonging to first to P-th pixel blocks are allowed to emit light simultaneously on a pixel-block basis sequentially in order from the first to P-th pixel blocks, and when the light emission sections configuring the pixels belonging to part of the pixel blocks are allowed to emit light, the light emission sections configuring the pixels belonging to rest of the pixel blocks are not allowed to emit light.

[B03] The display according to [B01] or [B02], wherein the light-emission section emits light a plurality of times based on a plurality of the control pulses.

[B04] The display according to [B03], wherein a time interval of the plurality of control pulses is constant.

[B05] The display according to any one of [B01] to [B04], wherein number of the control pulses supplied to the drive circuits in one display frame is less than number of the control pulses in one display frame.

[B06] The display according to any one of [B01] to [B05], wherein light is emitted constantly from any of the pixel blocks in one display frame.

[B07] The display according to any one of [B01] to [B05], wherein the pixel block from which no light is emitted is present in one display frame.

[B08] The display according to any one of [B01] to [B07], further including a control-pulse generation circuit configured to generate a control pulse having sawtooth-waveform voltage variation.

[B09] The display according to any one of [B01] to [B08], wherein an absolute value of a voltage of each of the control pulses increases and then decreases over time.

[B10] The display according to [B09], wherein gamma correction is performed based on the voltage of the control pulse that varies over time.

[B11] The display according to [B10], wherein an absolute value of a variation rate of the voltage of the control pulse using time as a variable is proportional to a constant 2.2.

[B12] The display according to any one of [B01] to [B11], wherein the light-emission section includes a light emitting diode.

[B13] (Display: First Configuration)

The display according to any one of [B01] to [B12], wherein the comparison section includes a signal writing transistor configured to receive the signal voltage, a control-pulse transistor configured to receive the control pulse, and configured to perform ON-OFF operation based on a signal of a phase opposite to a phase of a signal used by the signal writing transistor, an inverter circuit, and a capacity section having a first end and a second end, and configured to retain, based on operation of the signal writing transistor, the electric potential based on the signal voltage, the first end being connected to the signal writing transistor and the control-pulse transistor, and the second end being connected to the inverter circuit.

[B14] The display according to [B13], wherein the control pulse has sawtooth-waveform voltage variation, and the control section includes a first switching circuit connected in series to the inverter circuit, and configured to perform ON-OFF operation based on the sawtooth-waveform voltage variation of the control pulse.

[B15] The display according to [B14], wherein the control section includes a second switching circuit connected in parallel to the first switching circuit, and configured to be in an ON state during an operation period of the comparator unit.

[B16] The display according to [B14] or [B15], wherein the control section includes a resistive element connected in series to the inverter circuit.

[B17] The display according to any one of [B14] to [B16], wherein the control section includes a constant current source connected in series to the inverter circuit, and configured to suppress a current flowing through the inverter circuit.

[B18] The display according to [B17], wherein the inverter circuit includes inverters in two-or-more-stage cascade connection, and the constant current source is connected to the inverter of a first stage on a side, with respect to the inverter of the first stage, where one of a power supply on high potential side and a power supply on low potential side is provided, and the constant current source is connected to the inverter of a second stage on a side, with respect to the inverter of the second stage, where the other of the power supply on the high potential side and the power supply on the low potential side is provided.

[B19] (Display: Second Configuration)

The display according to any one of [B01] to [B12], wherein the comparison section includes a differential circuit configured to receive the signal voltage and the control pulse as two inputs, and a constant current source configured to supply a constant current to the differential circuit.

[B20] The display according to [B19], wherein the comparison section further includes a signal writing transistor configured to receive the signal voltage, and a capacity section connected to the signal writing transistor, and configured to retain, based on operation of the signal writing transistor, the electric potential based on the signal voltage.

[B21] The display according to [B19] or [B20], wherein the control pulse has sawtooth-waveform voltage variation, and the control section includes a third switching circuit connected in series to the constant current source, and configured to perform ON-OFF operation based on the sawtooth-waveform voltage variation of the control pulse.

[B22] The display according to [B21], wherein the control section includes a second switching circuit connected in series to a constant-voltage circuit, and configured to perform ON-OFF operation based on the sawtooth-waveform voltage variation of the control pulse, the constant-voltage circuit being configured to apply a constant voltage to a gate electrode of a transistor configuring the constant current source.

[B23] The display according to any one of [B13] to [B22], wherein, in each of the pixel blocks, the signal writing transistors of all of the pixels belonging to one line arranged in the second direction are allowed to be in an operation state simultaneously.

[B24] The display according to [B23], wherein, in each of the pixel blocks, an operation in which the signal writing transistors of all of the pixels belonging to the one line arranged in the second direction are allowed to be in the operation state simultaneously is sequentially performed from the signal writing transistors of all of the pixels belonging to a first row to the signal writing transistors of all of the pixels belonging to a last row, the first row to the last row being arranged in the first direction.

[B25] The display according to [B24], wherein, in each of the pixel blocks, the operation in which the signal writing transistors of all of the pixels belonging to the one line arranged in the second direction are allowed to be in the operation state simultaneously is sequentially performed from the signal writing transistors of all of the pixels belonging to the first row to the signal writing transistors of all of the pixels belonging to the last row, the first row to the last row being arranged in the first direction, and then the control pulse is supplied to each of the pixel blocks.

[B26] The display according to any one of [B01] to [B25], wherein the pixels belonging to one line arranged in the second direction are connected to a control pulse line, and voltage follower circuits (buffer circuits) are provided with a predetermined distance in between in the control pulse line.

[C01] (Method of Driving Display)

A method of driving a display with a plurality of pixels arranged in a two-dimensional matrix, the pixels each including a light-emission section and a drive circuit configured to drive the light-emission section, the drive section including a comparator unit configured to compare a control pulse with an electric potential based on a signal voltage, and to output a predetermined voltage based on a comparison result, and a light-emission-section driving transistor configured to supply a current to the light-emission section in response to the predetermined voltage from the comparator unit, thereby allowing the light-emission section to emit light, the method including:

controlling, based on the control pulse, operation and non-operation of the comparator unit.

It should be understood by those skilled in the art that various modifications, combinations, sub-combinations, and alterations may occur depending on design requirements and other factors insofar as they are within the scope of the appended claims or the equivalents thereof.

What is claimed is:

1. A display comprising:

a plurality of pixels arranged in a two-dimensional matrix, the pixels each including a light-emission section and a drive circuit configured to drive the light-emission section, such that there are a plurality of light emission-sections, the drive circuit including a comparator section configured to compare a control pulse with an electric potential based on a signal voltage, and to output a predetermined voltage based on a comparison result, and a light-emission section driving transistor configured to supply a current to the light-emission section in response to the predetermined voltage from the comparator section, thereby allowing the light-emission section corresponding to the drive circuit to emit light, and the comparator section including a signal writing transistor configured to receive the signal voltage, an inverter circuit, and a capacitor configured to include an input point and an output point, and compares a voltage of the output point with a predetermined voltage, control circuitry configured to receive the control pulse, and to perform ON-OFF operation based on a signal of a phase opposite to a phase of a signal used by the signal writing transistor, and the capacitor is configured to retain, based on operation of the signal writing transistor, the electric potential based on the signal voltage.

2. The display according to claim 1, wherein the plurality of pixels are arranged in a two-dimensional matrix in a first direction and a second direction, and are divided into a P-number of pixel blocks in the first direction, and the light-emission sections configuring pixels belonging to first to P-th pixel blocks are allowed to emit light simultaneously on a pixel-block basis sequentially in order from the first to P-th pixel blocks, and when the light emission sections configuring the pixels belonging to part of the pixel blocks are allowed to emit light, the light emission sections configuring the pixels belonging to rest of the pixel blocks are not allowed to emit light.

3. The display according to claim 1, wherein the control pulse is one of a plurality of control pulses and the light-emission section emits light a plurality of times based on the plurality of the control pulses.

4. The display according to claim 1, wherein light is emitted constantly from any of the pixel blocks in one display frame.

5. The display according to claim 1, wherein the pixel block from which no light is emitted is present in one display frame.

6. The display according to claim 1, wherein an absolute value of a voltage of each of the control pulses increases and then decreases over time.

7. The display according to claim 1, wherein the light-emission section includes a light emitting diode.

* * * * *